US005937228A

United States Patent [19]

Shoji et al.

[11] Patent Number: 5,937,228

[45] Date of Patent: Aug. 10, 1999

[54] IMAGE FORMING APPARATUS

[75] Inventors: Hisashi Shoji; Masahiko Shakuto; Nobutaka Takeuchi, all of Kanagawa; Hirokatsu Suzuki, Chiba, all of Japan

[73] Assignee: Ricoh Company, Ltd., Tokyo, Japan

[21] Appl. No.: 09/008,841

[22] Filed: Jan. 20, 1998

[51] Int. Cl.[6] ..... G03G 15/06

[52] U.S. Cl. ..... 399/55; 399/44; 399/270; 399/285

[58] Field of Search ..... 399/53, 55, 235, 399/285, 270, 97, 44

[56] References Cited

U.S. PATENT DOCUMENTS

| | | | |
|---|---|---|---|
| 4,314,755 | 2/1982 | Kinashi | 399/44 |
| 5,187,523 | 2/1993 | Osawa | 399/270 |
| 5,202,731 | 4/1993 | Tanikawa et al. | 399/270 |
| 5,307,127 | 4/1994 | Kobayashi et al. | 399/103 |
| 5,655,191 | 8/1997 | Furuya et al. | 399/270 X |
| 5,678,130 | 10/1997 | Enomoto et al. | 399/55 |
| 5,752,140 | 5/1998 | Dunzuka et al. | 399/270 |

FOREIGN PATENT DOCUMENTS

| | | |
|---|---|---|
| 3-67278 | 3/1991 | Japan . |
| 4-136959 | 5/1992 | Japan . |
| 4-143774 | 5/1992 | Japan . |
| 4-162059 | 6/1992 | Japan . |
| 4-356076 | 12/1992 | Japan . |
| 5-119592 | 5/1993 | Japan . |
| 60-073647 | 4/1995 | Japan . |
| 7-114223 | 5/1995 | Japan . |
| 7-333957 | 12/1995 | Japan . |
| 8-62955 | 3/1996 | Japan . |

*Primary Examiner*—Matthew S. Smith
*Attorney, Agent, or Firm*—Oblon, Spivak, McClelland, Maier & Neustadt, P.C.

[57] ABSTRACT

An image forming apparatus of the present invention is capable of forming an oscillation electric field in a developing region on the basis of the particle size of toner and the particle size of magnetic carrier. Assume that the oscillation electric field includes a phase for causing the toner to move toward a latent image and having a duration $t_1$, that the electric field has a period T, that the toner has a weight-average particle size of $L_t$, and that the carrier has a weight-average particle size of $L_c$. Then, there hold a relation of $1.0\times10^{-4}<t_1^2/L_t<1.0\times10^{-3}$ [sec$^2$/m] and a relation of $T^2/L_c<0.005$ [sec$^2$/m]. The apparatus insures images with uniform dots and including a minimum of noise.

27 Claims, 15 Drawing Sheets

| | + | − |
|---|---|---|
| ESTIMATED CHARGE | | |
| | | |
| | | |
| | ---- | ---- |

IMAGE FORMING APPARATUS

BACKGROUND OF THE INVENTION

1. Field of the Invention

The present invention relates to a copier, facsimile apparatus, printer or similar image forming apparatus and, more particularly, to a developing device included in an image forming apparatus for conveying a developer consisting of toner and carrier to a developing region while retaining it thereon, and causing the toner to deposit on a latent image electrostatically formed on an image carrier.

2. Discussion of the Background

A developing system using a developer consisting of toner and carrier, i.e., two-ingredient type developer has been customary with an electrophotographic or similar image forming apparatus due to its adaptability to high speed image formation. This kind of developing system is predominant in the field of products including copiers and laser printers. The developing system uses a nonmagnetic sleeve or similar developer carrier in which magnets are disposed. The developer carrier conveys the developer to a developing region while retaining it on its surface. In the developing region, the developer forming a brush contacts or adjoins an image carrier on which a latent image is electrostatically formed. The developer carrier is applied with an electric bias and forms an electric field between it and the image carrier, so that the toner is selectively deposited on the latent image to produce a corresponding toner image.

There is an increasing demand for high image quality on the market of image forming apparatuses of the type using the two-ingredient type developer. In this respect, image noise ascribable to the irregular deposition of the toner on the latent image is a critical problem. In a printer or a digital copier, for example, smooth halftone is not achievable unless dots are uniformly formed at intervals of several ten microns. In practice, dots are different in shape and area from each other, and the toner is irregularly deposited between clots, as observed through a microscope. An image with such irregularities appears rough and lacks uniformity.

To solve the above problem, there has been proposed to apply a bias for development including an oscillation component (oscillation bias hereinafter) to the developer carrier in, e.g., Japanese Patent Laid-Open Publication Nos. 3-67278, 4-162059, 4-356076, 7-114223, 7-333957, and 8-62955.

In the above developing system using the two-ingredient type developer, the amount of charge to deposit on the toner tends to vary as the toner content of the developer varies in dependence on the duration of agitation of the developer, toner consumption, and toner replenishment. That is, there is a trade-off between the toner content and the amount of charge. Further, image density tends to decrease with an increase in the amount of charge to deposit on the toner. This tendency is noticeable when the bias to be applied between the developer carrier and the image carrier is implemented only by a DC voltage. In light of this, the rotation speed of the developer carrier may be increased, or the gap between the developer carrier and the image carrier may be reduced, as well known in the art. However, the problem with this kind of scheme is that the carrier existing on the developer carrier scrapes off the toner image formed on the image carrier, blurring the trailing edge portion of the image or rendering lines uneven in width.

An implementation capable of increasing image density by solving the above problem and well known in the art is as follows. For the bias for development, use is made of a DC voltage on which an AC voltage is superposed. This kind of bias forms an oscillation electric field in the developing region where the developer carrier and image carrier face each other. Charged toner is caused to deposit on a latent image formed on the image carrier in the oscillation electric field. With this implementation, it is possible to activate the toner due to the oscillation of the AC voltage and to optimize frequency and peak-to-peak value which is the absolute value of a difference between the maximum value and the minimum value of the AC voltage. As a result, not only image density is increased, but also image quality is enhanced.

The prerequisite for high image quality is that the toner be efficiently deposited on the image portion of the image carrier, but prevented from depositing on the non-image portion of the same. To meet this requirement, it has recently been proposed to provide the AC voltage with a rectangular waveform and change the duty ratio of the AC voltage.

For example, Laid-Open Publication No. 7-33957 mentioned earlier discloses a developing device in which the potential of an AC voltage causing the toner to move toward the image carrier and the potential of the same causing the toner to move toward the developer carrier are fixed, and only the duty ratio of the rectangular AC voltage is varied. In the developing device, a time-average voltage is calculated from the above duty ratio and a peak-to-peak value which is the absolute value of a difference between the above two different potentials. The duty ratio of the AC voltage is controlled in order to vary the peak-to-peak value. As a result, a potential difference between the time-average voltage and the potential of the exposed portion or image portion of the image carrier is varied in order to increase image density. Further, to obviate the deposition of the carrier and the deposition of the toner on the non-image portion, i.e., fog, the peak-to-peak value is selected such that the potential causing the toner to move from the developer carrier toward the image carrier does not exceed the potential of the non-image portion or non-exposed portion of the image carrier.

Japanese Patent Laid-Open Publication No. 4-136959 teaches that the phase of the AC voltage causing the toner to move from the developer carrier toward the image carrier has a rectangular wave duty ratio of less than 50% inclusive, and that the AC voltage has a great peak-to-peak value. In this condition, a difference between the potential of the AC voltage causing the toner to move from the developer carrier toward the image carrier and the potential deposited on the image portion of the image carrier after exposure is made greater than a difference between the potential causing the toner to move from the image carrier toward the developer carrier and the potential of the image portion of the image carrier. This successfully increases image density. Further, the duration of the bias causing the toner deposited on the non-image portion to return to the developer carrier is increased in order to obviate fog. In addition, the oscillation of the AC voltage activates the toner and thereby enhances image quality.

The methods of the kind applying an oscillation bias to the developer carrier and as discussed above have a problem that they fail to improve image quality, but rather degrade it, depending on the conditions of bias application. We confirmed this problem by a series of experiments. This problem is presumably ascribable to the movement of toner and carrier which is susceptible to various factors.

Particularly, laid-Open Publications 4-356076, 7-993957 and 8-62955 describe specific conditions on frequency, peak-to-peak value and duty ratio relating to the oscillation bias having a pulse waveform. The conditions, however, do not take account of the characteristic of the developer which is caused to move by the bias, and therefore cannot insure desirable image quality with various kinds of toner and carrier.

Laid-Open Publication No. 7-114223 teaches specific ranges of particles sizes of toner and carrier and specific frequencies of the oscillation bias. This document describes that frequencies higher than 6,000 Hz inclusive are preferable, and that the carrier should preferably have a volume resistivity of 10 Ωcm in order to maintain the developing efficiency. We, however, found that the above frequency range is apt to cause the trailing edge portion of a solid image to be blurred, and that the effect of the oscillation bias is practically lost when the frequency is increased limitlessly.

Although a low resistance carrier slightly improves the above point, compared to a conventional carrier having a resistance of $10^{12}$ Ωcm, it cannot realize satisfactory image quality.

When the two-ingredient type developer is used, the toner deposits on the carrier due mainly to an electrostatic force. The oscillation bias cancels the restraint of the carrier on the toner and allows it to move easily in the electric field. However, the toner is prevented from leaving the carrier when the frequency of the oscillation bias is raised, i.e., when the duration of the phase causing the toner to move in a particular direction is reduced. Conversely, when the frequency is lowered, the span of movement of the toner increases and causes the toner to deposit on the background of the image carrier. Moreover, the carrier reacts to the oscillation electric field more positively and starts moving. This results in the deposition of the carrier on the image surface or the movement of the toner deposited on the image carrier, deteriorating image quality.

An image forming apparatus with the conventional developing device has another problem that when, e.g., the composition of the developer is changed due to version-up, developing conditions matching with a new developer cannot be set.

The arrangement taught in Laid-Open Publication No. 7-333957 discussed as above is capable of improving image density. However, a series of experiments showed that the oscillation of the toner available with the AC voltage is limited by the limited peak-to-peak value of the AC voltage of the bias, deteriorating the effect of the AC voltage. As a result, the uniformity of dots is degraded, preventing high quality images from being attained.

The arrangement taught in Laid-Open Publication No. 4-136959 is disadvantageous in that because the developing conditions are maintained constant at all times, the variation of the amount of charge to deposit on the toner is apt to cause image density to fluctuate.

SUMMARY OF THE INVENTION

It is therefore an object of the present invention to provide an image forming apparatus insuring a high quality image having uniform dots and including a minimum of noise.

It is another object of the present invention to provide an image forming apparatus capable of maintaining image density stable and insuring a high quality image having uniform dots and including a minimum of noise.

In accordance with the present invention, an image forming apparatus includes an image carrier for electrostatically forming a latent image thereon. A developer carrier conveys a developer consisting of toner and carrier while retaining the developer thereon, and causes the toner to deposit on the latent image formed on the image carrier. An arrangement is provided for forming an oscillation electric field between the image carrier and the developer carrier for causing the toner to move. Assuming that a period of time assigned to a phase for causing the toner to move toward the latent image is $t_1$, that a period of the oscillation electric field is T, a mass-average particle size of the toner is $L_t$, and that a mass-average particle size of the carrier is $L_c$, there hold relations:

$$1.0\times10^{-4}<t_1^2/L_t<1.0\times10^{-3}[\sec^2/m]$$

$$T^2/L_c<0.005[\sec^2/m]$$

Also, in accordance with the present invention, an image forming apparatus includes an image carrier for electrostatically forming a latent image thereon. A developer carrier conveys a developer consisting of toner and carrier while retaining the developer thereon, and causes the toner to deposit on the latent image formed on the image carrier. An arrangement is provided for forming an oscillation electric field between the image carrier and the developer carrier for causing the toner to move. The carrier has a volume resistivity of lower than $10^{10}$ Ωcm inclusive. Assuming that a period of time assigned to a phase for causing the toner to move toward the latent image is $t_1$, that a period of the oscillation electric field is T, a mass-average particle size of the toner is $L_t$, and that a mass-average particle size of the carrier is $L_c$, there hold relations:

$$1.0\times10^{-4}<t_1^2<5.0\times10^{-4}[\sec^2/m]$$

$$T^2/L_c<0.002[\sec^2/m]$$

Further, in accordance with the present invention, an image forming apparatus includes an image carrier for electrostatically forming a latent image thereon. A developer carrier conveys a developer consisting of toner and carrier while retaining the developer thereon, and causing the toner to deposit on the latent image formed on the image carrier. A controller forms, with an AC voltage and a DC voltage, an oscillation electric field for causing the toner to move between the image carrier and the developer carrier, and varies the duty ratio of the AC voltage and the DC voltage.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

The background of the present invention will be described first in order to better understand the preferred embodiments of the invention. With the results of extended researches and experiments, we found that image quality can be improved if an oscillation electric field with limited conditions is applied to a developing region between an image carrier and a developer carrier in which toner is movable, as follows.

Figure 26:
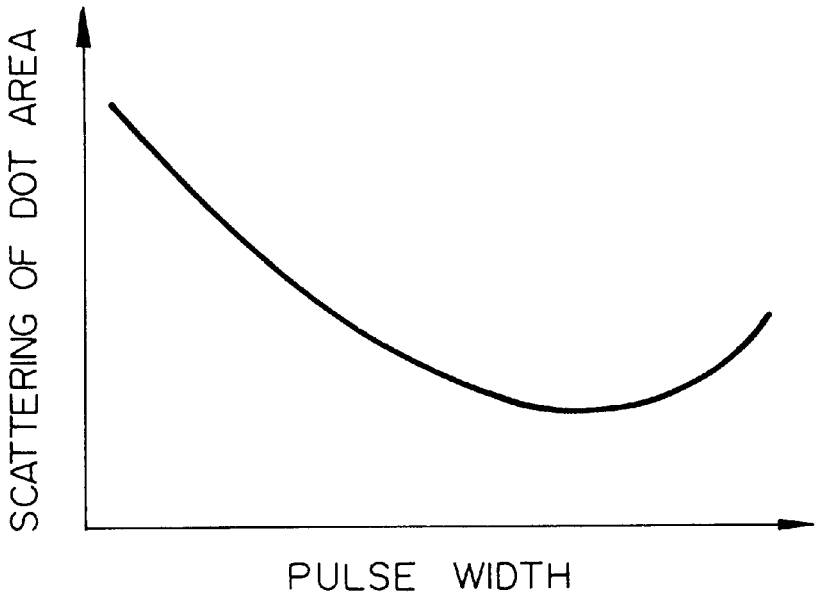
FIG. 26 shows a relation between the pulse width of a bias having a rectangular waveform and the irregularity in the area of a dot.

While a rectangular wave bias having a constant period was applied to a developer carrier, images were formed with the duration of movement of toner toward the image carrier being sequentially varied. The above duration refers to the width of a pulse causing the toner to move toward the image carrier. Under the above condition, scattering in the area of a dot was measured. The scattering was found to decrease in a particular range of pulse width, i.e., duty ratio (because the period is constant) and to improve the uniformity of dots, as shown in FIG. 26. In FIG. 26, the abscissa and ordinate respectively indicate the pulse width of the bias a n d scattering in the area of a dot (produced by dividing a standard deviation by a mean value). To determine the areas of dots, use was made of a metal microscope for enlarging dots, a CCD camera for reading the enlarged images of the dots, and software for analyzing image data output from the camera. As FIG. 26 indicates, scattering decreases in a particular range of pulse width, i.e., duty ratio.

On the other hand, prediction with a simple model showed that when charged particles are placed in an oscillation electric field, they start moving back and forth, and the amplitude of the movement is inversely proportional to the square of the frequency of the electric field and the particle size. Assume that the oscillation electric field has a frequency f and an amplitude $E_0$, and that the toner has a particle size $L_t$. Then, the reciprocating movement of the toner has an amplitude A expressed as:

$$A=k\cdot E_0/(f^2\cdot L_t) \tag{1}$$

Figure 27:
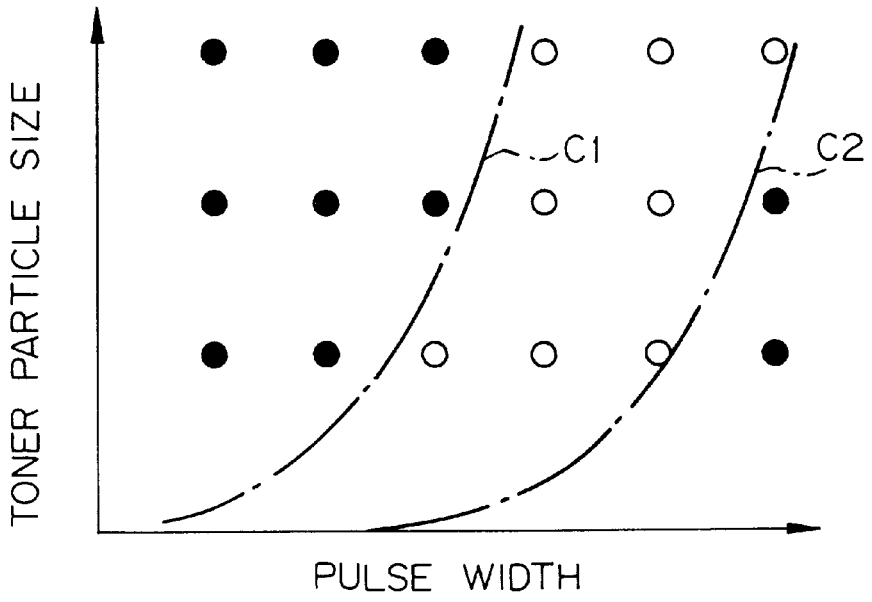
FIG. 27 shows the distribution of dot reproducibility determined by varying the particle size of toner and the level of the duty ratio of the bias having a rectangular waveform.

We hypothesized, based on the above results, that image quality is related to the duration of high-speed movement of the toner toward the image carrier and the particle size of the toner, and conducted experiments with the intention of confirming the hypothesis. Specifically, images were formed with the particle size of the toner and the level of the duty ratio of the bias being sequentially varied. The evaluation of the images proved that the reproducibility of dots noticeably increases if a value produced by dividing the square of the duration for which the toner moves toward the image carrier (i.e. the width of a pulse causing the toner to move toward the image carrier) by the particle size of the toner is confined in a particular range, as shown in FIG. 27. In FIG. 27, the abscissa and ordinate respectively indicate the pulse width of the bias and the particle size of the toner. FIG. 27 compares the data with respect to each particular particle size; circles and dots respectively show data representative of high uniformity of dots and data representative of low uniformity of dots. As shown, high uniformity of dots is achievable in the range delimited by two parabolic curves C1 and C2.

For the above experiments, use was made of magnetic carrier consisting of ferrite cores and silicone resin coating the cores, and having a volume resistivity of about $10^{12}$ Ωcm. Almost the same results were obtained when use was made of magnetic carrier consisting of resin and fine magnetite particles dispersed in the resin and having a volume resistivity of about $10^{13}$ Ωcm.

We therefore concluded that image quality is improved if the electric field is so formed as to satisfy the following relation:

$$1.0\times10^{-4}<t_1^2/L_t<1.0\times10^{-3}[\sec^2/m] \tag{2}$$

where $t_1$ denotes the duration (pulse width) of the phase causing the toner to move toward the image portion of a latent image formed on the image carrier, and $L_t$ denotes the weight-average particle size of the toner.

Further, we studied the movement of the carrier. Studies in the past allowed us to expect that when the carrier moves actively, it is apt to deposit on the image carrier or scrape off the toner developed a latent image and thereby lower image quality.

Assuming that the carrier, like the toner, is constituted by charged particles, then the movement of the carrier can safely be assumed to be inversely proportional to the square of the frequency of the oscillation electric field and the particle size of the carrier. When images were formed with the carrier particle size and electric field frequency being sequentially varied and evaluated, it was found that carrier deposition on the image surface does not occur if a value produced by dividing the square of the period of the electric field by the carrier particle size is confined in a particular range. Specifically, image quality is improved if the above electric field satisfies the following relation:

$$T^2/L_c<0.005[\sec^2/m] \quad (3)$$

where T denotes the period of the electric field, and $L_c$ denotes the weight-average particle size of the magnetic carrier.

It follows that if conditions satisfy the relations (2) and (3), there can be realized a state in which the toner moves easily while the carrier moves little. This not only enhances the reproducibility of halftone, but also noticeably reduces image noise including background contamination and the blurring of the trailing edge.

When use was made of carrier consisting of ferrite and resin coating it and containing carbon (fine conductive particles) in order to implement a volume resistivity of $10^8$ Ωcm, images substantially free from image noise and achieving more uniform dots were output if the following relations were satisfied:

$$1.0\times10^{-4}<t_1^2/L_t<5.0\times10^{-4}[\sec^2/m] \quad (4)$$

$$T^2/L_c<0.002[\sec^2/m] \quad (5)$$

When the above low resistance carrier is used, the oscillation electric field in the developing region increases in size and further activates the movement of the toner, allowing the toner to deposit on a latent image more faithfully. Another advantage achievable with such toner is that the charge deposited on the surface of the carrier become uniform easily, freeing the toner left the carrier from intense electrostatic attraction. This allows a minimum of image noise to occur.

On the other hand, in the developing device using the two-ingredient type developer, the toner is charged due mainly to friction acting between it and the magnetic carrier. The amount of charge to deposit on the toner for a unit mass is distributed over a certain range due to scattering in the surface characteristic and particle size of each of toner and carrier. It has therefore been difficult to obviate toner on which substantially no charge is deposited (toner of short charge hereinafter). The toner of short charge is apt to float away from the magnetic carrier and deposit on the background of an image, constituting one of various causes of image noise. In addition, the toner of short charge is apt to fly about and contaminate the inside of the apparatus.

To obviate the toner of short charge, the mean amount of charge to deposit on the toner may be increased. This, however, brings about another problem that the toner with a great amount of charge strongly adheres to the magnetic carrier and cannot deposit on a latent image in a required amount, preventing a stable developing characteristic from being achieved.

We conducted a series of studies and experiments on the conditions of the oscillation electric field which should be set up when the mean amount of charge on the toner is increased. The studies and experiments showed that even when the mean amount of charge is increased within a preselected range in order to obviate the toner of short charge, a stable developing characteristic free from the fall of developing ability is achievable if an oscillation electric field allowing the toner to move easily toward the image carrier, but causing the carrier to move little, is formed, taking account of the particle size of the toner and that of the magnetic carrier.

Further, we conducted experiments with a developing device using low resistance magnetic carrier under the above particular condition of the oscillation electric field. The experiments showed that the charge holding ability of such carrier is too low to retain the charge of the toner over a long period of time. As a result, the amount of charge deposited on the toner is apt to vary and render the developing characteristic unstable.

For example, after the developing device is left unused over a long period of time, the amount of charge deposited on the toner falls and is apt to cause the toner to deposit on the image carrier easily. This is likely to increase image density excessively or bring about background contamination when image formation is effected later. Further, when the developing device is continuously operated while mixing the developer, the amount of charge deposited on the toner sequentially increases and is apt to lower the developing ability to such a degree that sufficient image density is lost.

The amount of charge to deposit on the toner is susceptible to environmental conditions, particularly humidity. Generally, the amount of charge increases when humidity is low or decreases when it is high. Therefore, when humidity around the developer varies, the amount of charge also varies and is likely to render the developing characteristic unstable. The amount of charge and therefore the developing characteristic is susceptible even to the toner content of the developer existing in the developing device.

Moreover, we found that when the duty ratio of the AC voltage is reduced without varying the time-average voltage of the bias, image density can be guaranteed more easily and the uniformity of dots is more enhanced than when the time-average voltage is varied in order to raise image density.

Preferred embodiments of the image forming apparatus in accordance with the present invention will be described with reference to the accompanying drawings.

1st Embodiment

Figure 1:
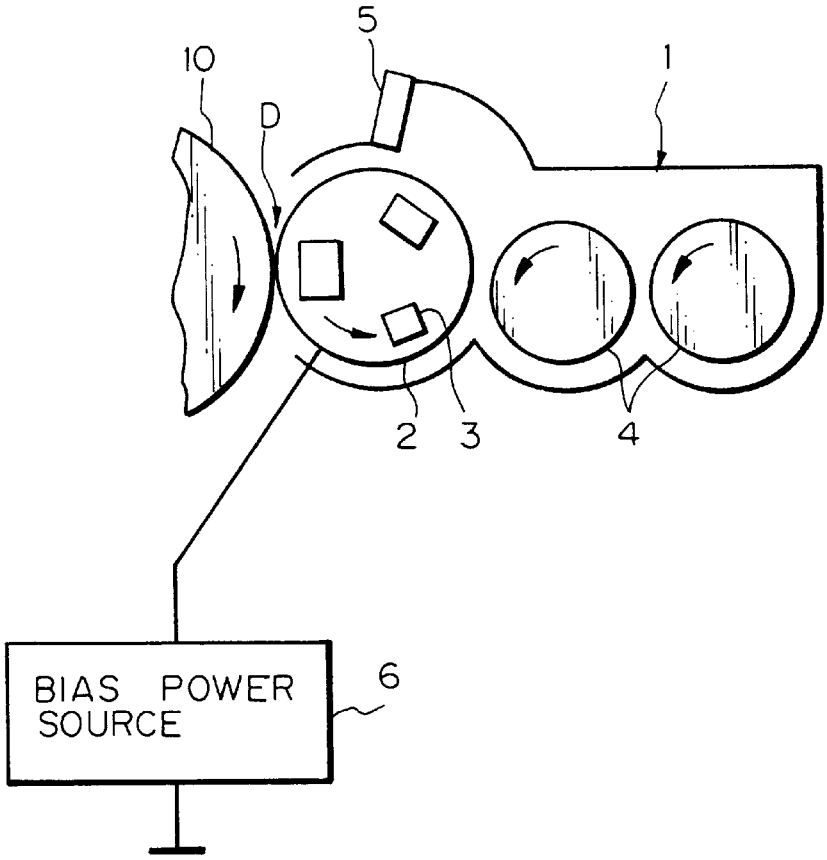
FIG. 1 is a section showing a developing device with which an image forming apparatus of the present invention is practicable.

Referring to FIG. 1 of the drawing, a developing device included in an image forming apparatus embodying the present invention is shown. The developing device is of the type conveying a toner and magnetic carrier mixture, i.e., two-ingredient type developer, to an image carrier with a developer carrier and developing a latent image electrostatically formed on the image carrier.

As shown, the developing device, generally 1 includes a developing sleeve or developer carrier 2, two agitators 4, and a doctor blade 5. The sleeve 2 is formed of a nonmagnetic conductive material and has a surface provided with suitable degree of irregularity by, e.g., sand blasting. The sleeve 2 is rotatable counterclockwise, as indicated by an arrow in FIG. 1. A plurality of magnets 3 are fixed in place within the sleeve 2. A bias power source 6 for development applies a bias (oscillation bias), which will be described later, to the sleeve 2. The two agitators 4 convey the developer in opposite directions to each other, as seen at the gap between the agitators 4. The doctor blade 5 is positioned above and in the vicinity of the sleeve 2 in order to regulate the amount of developer to reach a developing region D.

When the developer agitated and conveyed by the two agitators 4 approaches the sleeve 2, it is transferred to the sleeve 2 by the force of the magnets 3. At the side upstream of the doctor blade 5 in the direction of rotation of the sleeve 2 (at the right-hand side of the blade 5 in FIG. 1), the developer convects with the result that the toner and carrier are mixed together while being sufficiently and uniformly charged.

The developer is brought to a developing region D in a constant amount due to the gap between the doctor blade 5 and the sleeve 2. In the developing region D, the toner is capable of moving toward a photoconductive element or image carrier 10 away from the sleeve 2. In this region D, a magnet brush consisting of the toner and carrier and formed by the magnets 3 contacts the drum 10. The toner moves from the sleeve 2 toward the drum 50 due to an electric field formed by the voltage applied to the sleeve 2 and latent image electrostatically formed on the drum 50.

Figure 2:
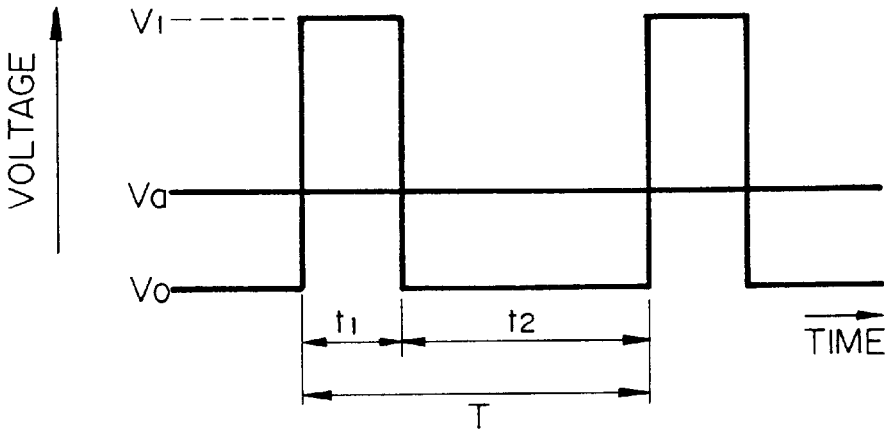
FIG. 2 shows the waveform of a bias for development applied to a developing sleeve included in the developing device.

FIG. 2 shows the waveform of the oscillation bias applied from the bias power source 6 to the sleeve 2. In FIG. 2, the abscissa indicates time while the ordinate indicates voltage. As shown, assume that the voltage exerting the maximum force causing the toner to move toward the drum 10 is $V_1$, that the voltage exerting the maximum force causing the toner to move toward the sleeve 2 is $V_0$, that the duration (pulse width) of the voltage $V_1$ is $t_1$, and that the period of the oscillation bias is T. The integral mean of the voltages is selected to be about −500 V to about −700 V like a usual DC bias; $V_a=V_0+(V_1-V_0)\cdot t_1/T$.

The bias applied to the sleeve 2 forms an oscillation electric field in the developing region D. One period T of the bias is made up of a first and a second period of time $t_1$ and $t_2$ respectively assigned to a first phase and a second phase, as shown in FIG. 2. The first period of time $t_1$ corresponds to the duration of a first phase of the oscillation electric field during which the toner tends to move toward the drum 10. The second period of time $t^2$ corresponds to the duration of a second phase of the above electric field during which the toner tends to move toward the sleeve 2.

In the illustrative embodiment, assuming that the toner and carrier respectively have mass-average particle sizes of $L_t$ and $L_c$, various conditions are so selected as to satisfy the relations (2) and (3).

As stated above, in the illustrative embodiment, an oscillation electric field is formed in the developing region. The period of time $t_1$ during which the toner moves toward the drum 10 is selected in accordance with the particle size of the toner. In addition, the period T of the oscillation electric field is selected in accordance with the particle size of the carrier. Under these conditions, an oscillation electric field optimal for the developer is formed and allows the toner to deposit on the latent image efficiently. This insures an image with uniform dots (uniform reproducibility of halftone) and including a minimum of noise. Specific examples of the illustrative embodiment are as follows.

In a first specific example, use was made of a developer consisting of resin-coated carrier having a mass-average particle size of 50 $\mu$m and a volume resistivity of $10^{12}$ Ωcm, and toner having a mass-average particle size of 7.5 $\mu$m. The developer had a toner content of 5 wt %. A potential of 700 V and a potential of −100 V were respectively deposited on the background and latent image of the drum 10.

The above volume resistivity of the carrier was measured by forming a magnet brush of carrier on the sleeve 2, setting a potential difference of 2,000 V between the drum 10 and an electrode identical in shape with the drum 10, and calculating a resistance based on the resulting current. Alternatively, the volume resistivity may be measured b y sandwiching a sample received in a receptacle with an upper and a lower electrode, lightly compressing the sample from above, and applying a voltage between the two electrodes in order to measure a current. For such alternative measurement, the sample in the receptacle is about 4 mm high while the voltage is varied from 100 V to 1,000 V; the mean value of the resulting currents is used as a volume resistivity.

The bias for development had an integral mean $V_a$ of −800 V, an oscillation component whose frequency was 5 kHz, and a peak-to-peak voltage of 2 kV. When the duty ratio of the oscillation bias ($=t_1/T$) was varied during repeated development, an image with uniform dots was achieved when the duty ratio was from 15% to 40%.

In a second example, the duty ratio of the bias for development was fixed at 20% while the same developer as in the first example was used. An image with uniform dots was obtained when the frequency of the bias was from 2.5 kHz to 7 kHz.

In a third example, the duty ratio of the bias for development was fixed at 10% while the same developer as in the first and second examples was used. A desirable image was obtained when the frequency of the bias was from 2 kHz to 9.5 kHz. Frequencies below 2 kHz noticeably aggravated the deposition of the carrier on an image.

In a fourth example, toner having a particle size of 5 $\mu$m (carrier having the same particle size as in the previous examples) was used while the frequency was fixed at 5 kHz. An image with uniform dots was output when the duty ratio of the bias was from 15% to 30%.

In a fifth example, the same developer as in the fourth example was used while the duty ratio of the bias was fixed at 20%. An image with uniform dots was produced when the frequency of the bias was from 3 kHz to 8.5 kHz.

In a sixth example, use was made of a developer consisting of resin carrier with magnetic fine particles dispersed therein and having a volume resistivity of $10^{13}$ Ωcm and a mass-average particle size of 35 $\mu$m, and toner having a particle size of 7.5 $\mu$m. When the duty ratio of the bias was fixed at 10%, a desirable image was obtained in a frequency range of from 2.5 kHz to 3.5 kHz. Frequencies below 2.4 kHz made the deposition of the carrier conspicuous.

Figure 3:
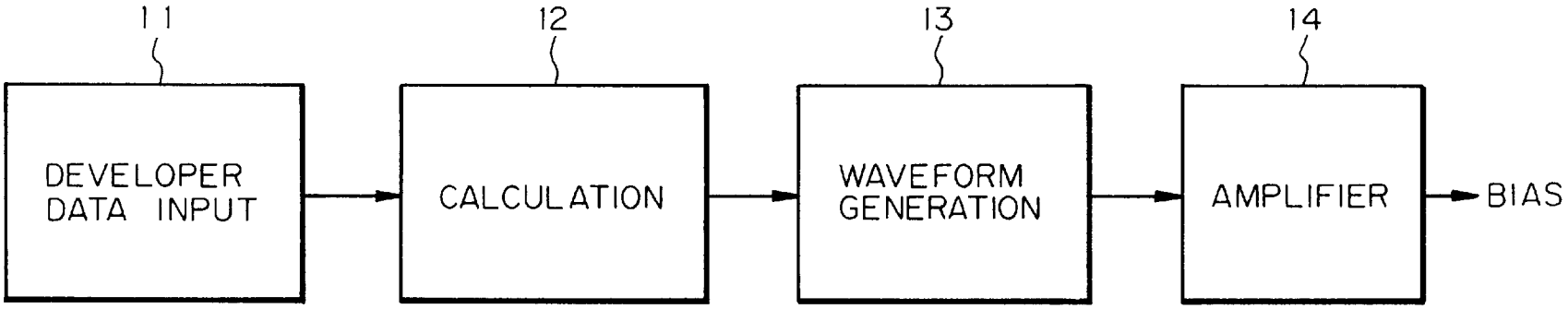
FIG. 3 is a block diagram schematically showing a system for generating the bias shown in FIG. 2.

FIG. 3 shows a system for generating the bias to be applied to the developing device 1. As shown, the system is made up of a developer data input 11, a calculation 12, a waveform generation 13, and an amplifier 14. The developer data input 11 stores data relating to the particle size of toner and that of carrier. The calculation 12 sets, based on such data, the pulse width of the bias within the range satisfying the relations (2) and (3) and delivers the resulting pulse width data to the waveform generation 13. In response, the waveform generation 13 generates a waveform. The amplifier 14 outputs a high voltage or bias for development having the above waveform and applies it to the sleeve 2, FIG. 1. The calculation 12 may determine, in addition to the pulse width, a peak-to-peak voltage and a DC component value based on other conditions; again, the pulse width should satisfy the relations. (2) and (3)

Usually, data relating to the particle size of the toner and that of the carrier are written to the developer data input 11 at the time of shipment and do not have to be rewritten. However, when the developer (composition) was changed for some reason, e.g., due to version-up, the data are updated. Development can therefore be effected under optimal conditions even when a new developer is used, insuring images of best quality at all times.

2nd Embodiment

This embodiment is also practicable with the configuration shown in FIG. 1. The following description will concentrate on features unique to the second embodiment. In this embodiment, use is made of a developer including carrier having a volume resistivity pc of less than $10^{10}$ Ωcm inclusive. Various conditions are so selected as to satisfy the relations (4) and (5).

Under the above conditions, it was possible to realize a state which promotes the movement of the toner, but causes the carrier to move little. As a result, halftone with uniform dots was achieved, and the deposition of the carrier was obviated to improve image quality. In addition, there were noticeably reduced the contamination of the background, the blurring of the trailing edge, and other phenomena referred to as image noise.

In the illustrative embodiment also forming the oscillation electric field, when the carrier was replaced with one having a volume resistivity ρc of higher than $10^{11}$ Ωcm inclusive, halftone portions lacked in uniformity, and image noise including the blurring of the trailing edge occurred.

When use is made of the oscillation electric field and magnetic carrier having a volume resistivity of lower than $10^{10}$ Ωcm inclusive, as in this embodiment, the electric field in the developing region D increases in size and renders the toner more active. Therefore, the toner can deposit on the latent image formed on the drum 10 more faithfully. Moreover, when the electric resistance of the magnetic carrier is low, the charge distribution on the carrier becomes uniform easily and makes it difficult for the electrostatic attraction acting on the toner left the carrier to increase. This successfully allows a minimum of image noise to occur. Specific examples of the second embodiment are as follows.

In a first example, use was made of a developer consisting of carrier coated with resin containing fine carbon particles, and toner having a mass-average particle size of 7.5 μm. The carrier had a mass-average particle size of 50 μm and a volume resistivity of $10^8$ Ωcm. The developer had a toner content of 5 wt % . A potential of −700 V and a potential of −100 V were respectively deposited on the background and latent image of the drum 10.

The bias for development had an integral mean $V_a$ of −600 V, an oscillation component whose frequency was 5 kHz, and a peak-to-peak voltage of 2 kV. The duty ratio of the bias was varied within the range satisfying the relations (4) and (5). An image with uniform dots was achieved when the duty ratio was from 15% to 30%.

In a second example, the duty ratio of the bias was fixed at 20% while the same developer as in the first example was used. An image with uniform dots was obtained when the frequency of the bias was from 3.5 kHz to 7 kHz.

In a third example, the duty ratio of the bias was fixed at 10% while the same developer as in the first and second examples was used. A desirable image was output when the frequency of the bias was from 3.2 kHz to 3.7 kHz. Frequencies lower than 3.2 kHz noticeably aggravated the deposition of the carrier while frequencies higher than 3.7 kHz degraded the uniformity of dots.

In a fourth example, use was made of toner having a particle size of 5 μm (carrier identical with one use in the above examples). The frequency of bias was fixed at 5 kHz. An image with uniform dots was achieved when the duty ratio was from 15% to 25%.

In a fifth example, the duty ratio of the bias was fixed at 20% while the same developer as in the fourth example was used. An image with uniform dots was output when the frequency of the bias was from 4 kHz to 8.5 kHz.

In a sixth example, use was made of a developer consisting of resin carrier with fine magnetic particles dispersed therein and having a volume resistivity of $10^8$ Ωcm, and toner having a particle size of 7.5 μm. The resin carrier was coated with a conductive material. When the duty ratio of the bias was fixed at 20%, an image with uniform dots was achieved when the frequency was from 4 kHz to 7 kHz. When the duty ratio was fixed at 10%, carrier deposition was conspicuous when the frequency was lower than about 3.8 kHz, and the uniformity of dots was not improved when the frequency was higher than about 3.8 kHz.

3rd Embodiment

A developing device implementing a third embodiment includes a developer carrier for carrying a developer consisting of toner and carrier, and oscillation electric field forming means for forming a first phase in which the toner tends to move toward the image carrier and a second phase in which it tends to move toward the developer carrier. The developing device develops a latent image formed on the image carrier with the developer conveyed to a developing region by the developer carrier. The basic configuration of the developing device is identical with the configuration shown in FIG. 1 and will not be described specifically.

In this embodiment, use may be made of carrier whose volume resistivity is as low as $10^{10}$ Ωcm or below in place of the high resistance carrier of the first embodiment. When use is made of the high resistance carrier of the first embodiment, it is preferable to select conditions satisfying the relations (2) and (3). By contrast, when use is made of the low resistance carrier of this embodiment, it is preferable to select conditions satisfying the relations (4) and (5).

Figure 4:
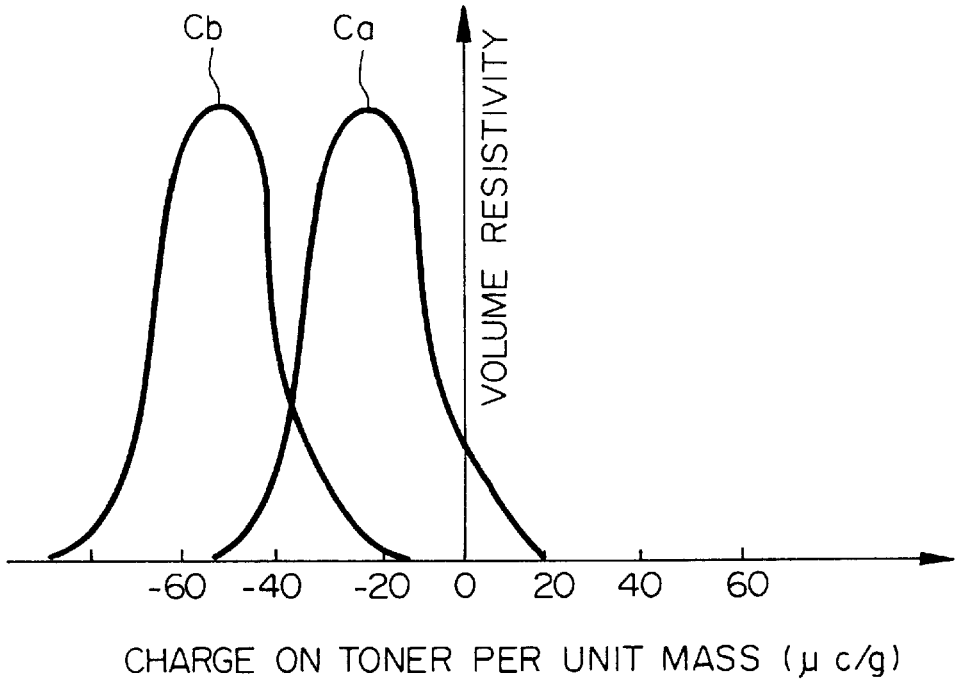
FIG. 4 shows distributions of the amounts of charge of developers.

For experiments, there were prepared, under the same conditions, two different kinds of toner a and b each containing a particular amount of charge control agent. The toner a and toner b were mixed with the same kind of carrier. FIG. 4 is a graph comparing the amounts of charge achievable with the toner a and toner b; curves Ca and Cb respectively correspond to the developer containing the toner a and the developer containing the toner b. For the measurement of the distributions of charge amounts, use was made of an analyzer available from Hosokawa Micron Corp. As FIG. 4 indicates, the developer with the toner a and the developer with the toner b have substantially the same width of distribution although they are different in the mean amount of charge for a unit mass. It will be seen that the toner a contains particles charged little while the toner b does not contain such particles.

The mean amounts of charge deposited on the toner a and toner b were measured to be −25 μC/g and −50 μC/g, respectively, by a blow-off method. The blow-off method is such that a cylindrical container (blow-off gauge) having meshes passing toner, but intercepting magnetic carrier, at both ends thereof is positioned horizontally, and air under pressure is blown into the container in order to measure the charge carried away by the toner.

The above experiments showed that for different kinds of toner produced under the same conditions, it is possible to eliminate toner of short charge liable to contaminate the background and cause the toner to fly if the charge is so controlled as to increase the mean amount of charge.

Figure 5:
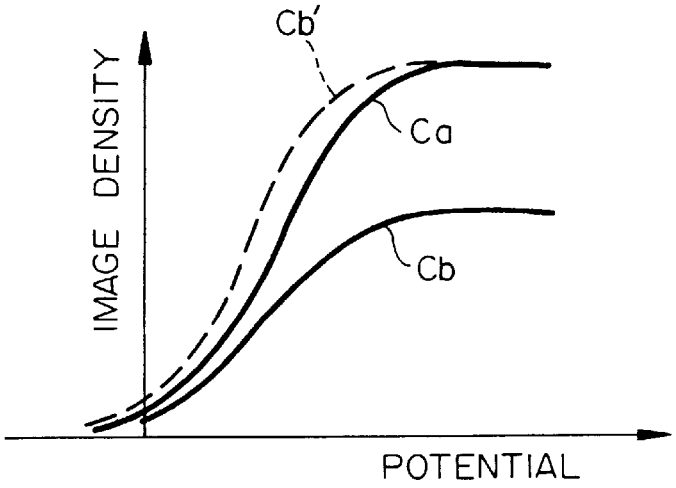
FIG. 5 shows a relation between a potential for development and image density.

FIG. 5 compares image densities derived from the toner a and toner b; the abscissa indicates potential. Curves Ca and Cb relate to the toner a and toner b, respectively, and were derived from the conventional bias constituting only of a DC voltage. A dashed curve Cb' was obtained when the toner b having a great mean amount of charge was used in combination with the bias forming the oscillation electric field. As FIG. 5 indicates, when the bias consisting only of a DC voltage is applied, the developing ability of the toner b having a great mean amount of charge falls noticeably. By contrast, when the oscillation electric field is applied, as in the illustrative embodiment, sufficiently high image density (amount of toner) is achievable, as indicated by the dashed curve Cb', and insures a stable developing characteristic.

The above experiment was repeated with various kinds of toner each having a particular mean amount of charge. The experiments showed that when use is made of toner whose mean amount of charge is greater than 40 $\mu$C/g inclusive in absolute value, as measured by the blow-off method, most of the toner achieves a sufficient amount of charge and does not contaminate the background or fly about. The experiments also showed that with toner whose mean amount of charge is less than 100 1m/g inclusive in absolute value, it is possible to output sufficiently high image density. Toner with a mean amount of charge of greater than 100 $\mu$C/g in absolute value did not promote development despite the application of the oscillation electric field and prevented sufficient image density from being achieved.

As stated above, in the illustrative embodiment, the mean amount of charge of toner is selected to be greater than 40 $\mu$C/g inclusive, but smaller than 100 $\mu$C/g inclusive in absolute value, as measured by the blow-off method. With such a mean amount of charge, the embodiment eliminates toner of short charge which is apt to contaminate the background and fly about, and insures a stable developing characteristic. In addition, the oscillation electric field prevents image density (amount of toner) from decreasing. Specific examples of this embodiment are as follows.

In a first example, the bias to be applied to the sleeve 2 had an integral mean $V_a$ of about −500 V to about −700 V like the conventional DC bias. Use was made of carrier coated with resin containing fine conductive carbon particles dispersed therein, and having a mass-average particle size of 50 $\mu$m and a volume resistivity of $10^{10}$ Ωcm. Three different kinds of toner having the mass-average particle size of 7.5 $\mu$m, but each containing a particular amount of charge control agent, were prepared. The three kinds of toner were mixed with the above magnetic carrier to implement a toner content of 5 wt %. The mean amounts of charge of such toner were measured to be −40 $\mu$C/g, −50 $\mu$C/g and −60 $\mu$C/g by the blow-off method.

Images were formed by the above developer and a bias having an integral mean $V_a$ of −600 V, a frequency of 5 kHz and a peak-to-peak voltage of 2 kV, and a duty ratio R ($-t_1/T$) for the first period of time sequentially varied. Images with uniform dots were achieved when the duty ratio R was from 15% to 30%.

When the duty ratio R was fixed at 20%, and the frequency j was varied, dots were faithfully reproduced when the frequency f was from 3.5 kHz to 7 kHz. Likewise, when the duty ratio R was fixed at 10%, and the frequency f was varied, dots were faithfully produced when the frequency f was from 3.2 kHz to 3.7 kHz. Frequencies f lower than the above range aggravated carrier deposition while frequencies f higher than the above range degraded the uniformity of dots.

In a comparative example, the amount of charge control agent added to the toner was reduced to produce toner whose mean charge amount was −30 $\mu$C/g. When images were formed under the above conditions, such toner contaminated the background and flew about noticeably.

In a second example, use was made of toner having a mass-average particle size of 5 $\mu$m. and a mean amount of charge of −70 $\mu$C/g. When the frequency f of the bias was fixed at 5 kHz, an image with uniform dots was achieved when the duty ratio R was from 15% to 25%. When the duty ratio R was fixed at 20%, an image with uniform dots was achieved when the frequency f was from 4 kHz to 8.5 kHz.

In a third example, use was made of a developer consisting of resin carrier with magnetic fine particles dispersed therein and having a mass-average particle size of 35 $\mu$m, and coated with a conductive layer to have a volume resistivity ρc of $10^8$ Ωcm, and toner having a mass-average particle size $L_t$ of 7.5 $\mu$m and a mean amount of charge of −50$\mu$C/g. When the duty ratio R was fixed at 10%, and when the frequency f was varied, carrier deposition was noticeable at frequencies f lower than 3.8 kHz inclusive. Frequencies f above 3.8 kHz did not improve the uniformity of dots at all. When the duty ratio was fixed at 20%, an image with uniform dots was achieved at frequencies f ranging from 4 kHz to 7kHz.

4th Embodiment

A developing device for this embodiment basically has the configuration shown in FIG. 1 except for the mean amount of charge of toner and will not be described specifically.

Figure 6:
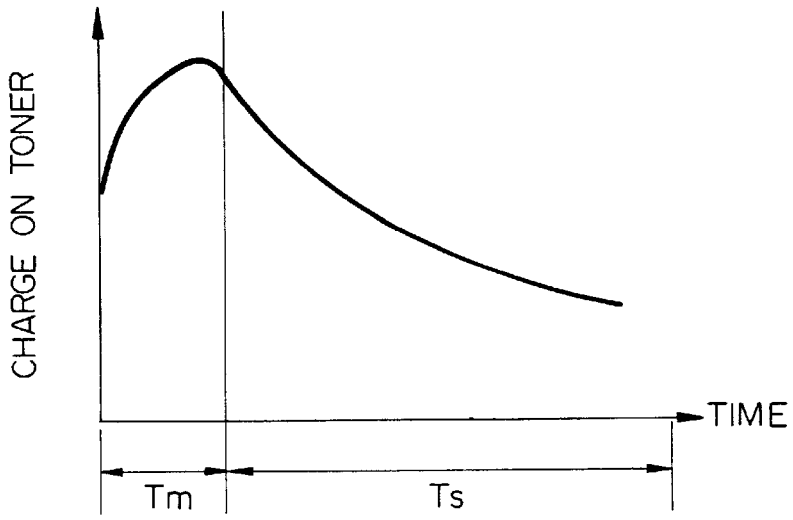
FIG. 6 shows how the amount of charge deposited on toner varies with the elapse of time.

FIG. 6 is a graph showing the variation of the amount of charge deposited on toner determined when the developer of the first embodiment containing the low resistance carrier and highly chargeable toner was mixed and left still. In FIG. 6, the developer is mixed over a period of time Tm and then left still over a period of time Ts. As shown, the developing characteristic varies in dependence on whether it is being mixed or left still. It follows that if the developing device is operated only for a short period of time or left still over a long period of time, image quality is apt to fall due to, e.g., an increase in image density or background contamination.

Figure 7:
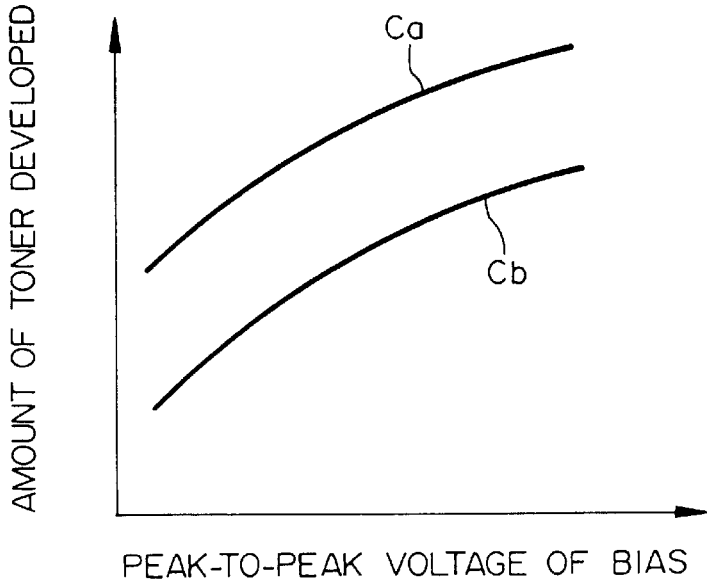
FIG. 7 shows a relation between the peak-to-peak voltage of the bias and the amount of toner developing a latent image.

FIG. 7 shows a relation between the peak-to-peak voltage of the bias of the first embodiment and the amount of toner deposited on a latent image and determined by experiments. Curves Ca and Cb respectively relate to the toner a having a small mean amount of charge and the toner b having a great mean amount of charge, as stated earlier. As for the toner a, it is possible to obviate excessive development by lowering the peak-to-peak voltage of the bias. In addition, background contamination is reduced at the same time although the uniformity of dots is degraded, as determined by experiments.

The results of experiments shown in FIGS. 6 and 7 indicate that if the the peak-to-peak voltage of the bias is determined in relation to the duration of continuous operation or the duration of stop of operation of the image forming apparatus (developing device), it is possible to obviate excessive toner deposition and background contamination. The actual peak-to-peak voltages should only be determined beforehand by, e.g., experiments.

Figure 8:
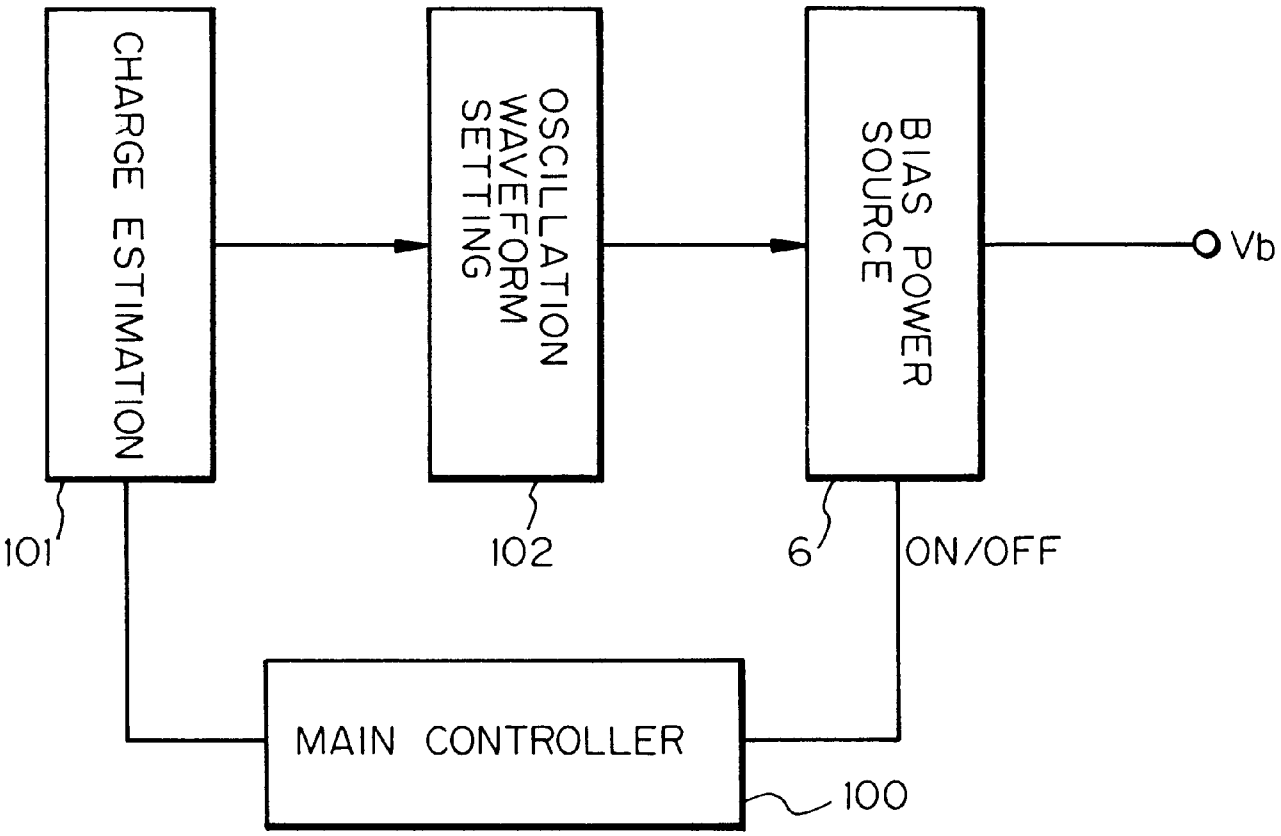
FIG. 8 is a block diagram schematically showing a control system representative of a fourth embodiment of the present invention.

FIG. 8 shows a control system or control means for varying, based on the above duration particular to the developing device, the peak-to-peak voltage of the bias corresponding to the peak-to-peak value of the oscillation electric field. As shown, a main controller 100 sends an ON/OFF control signal to a bias power source 6 at a necessary timing. In addition, the main controller 100 sends a signal showing whether or not the sleeve 2 is operating to a charge estimation 101 which estimates an amount of charge deposited on the toner. The charge estimation 101 estimates the current amount of charge deposited on the toner existing in the developing device and feeds it to an oscillation waveform setting 102 which sets the peak-to-peak voltage of the bias. A relation between the estimated amount of charge to deposit on the toner and the peak-to-peak voltage of the bias is stored in the oscillation waveform setting 102 in the form of a conversion table. The setting 102 sets a peak-to-peak voltage by referencing the conversion table. Data relating to the peak-to-peak voltage is delivered from the setting 102 to the bias power source 6. As a result, the bias power source 6 applies a bias $V_b$ having a newly set peak-to-peak voltage to the sleeve 2 in response to an ON signal received from the main controller 100.

Figure 9:
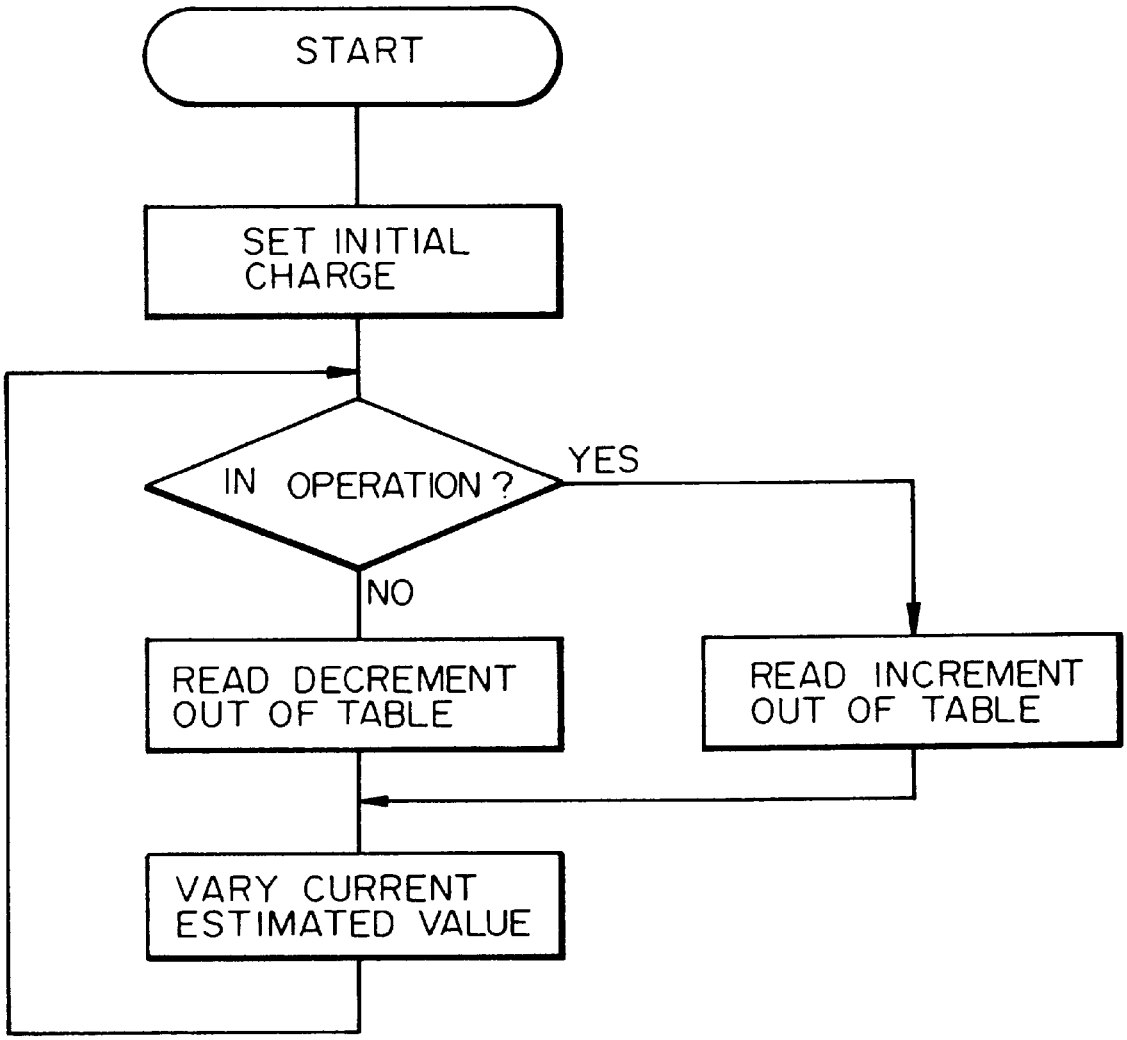
FIG. 9 is a flowchart demonstrating the operation of the control system shown in FIG. 8.
Figures 10, 11:
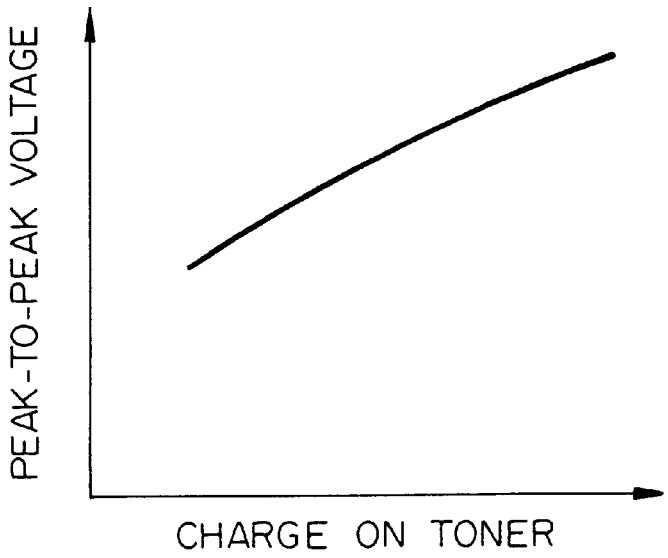
FIG. 10 shows an estimated charge list applicable for the control of the bias in the fourth embodiment.
FIG. 11 shows a relation between the amount of charge to deposit on toner and the peak-to-peak voltage of the bias.

FIG. 9 demonstrates the operation of the charge estimation 101 in a flowchart. A toner charge table (see FIG. 10) prepared beforehand on the basis of the data shown in FIG. 7 is stored in the charge estimation 101. As shown in FIG. 9, the charge estimation 101 replaces the estimated amount of charge by referencing the toner charge table at a preselected timing. The table shown in FIG. 10 lists increments to be effected during operation of the developing device in a column "+", and lists decrements to be effected during stop in a column "−" in relation to the estimated amounts of charge. Specifically, if the developing device is operating when the estimated charge amount has a certain value, the estimated charge is increased by the corresponding increment listed in the column "+". If the developing device is not operating, the estimated value is reduced by the corresponding decrement listed in the column "−". FIG. 11 shows specific contents of the conversion table stored in the oscillation waveform setting 102. As shown, a relation between the amount of charge to deposit on toner and the peak-to-peak voltage of the bias is determined beforehand on the basis of experimental data.

As stated above, even when the amount of toner to deposit on the toner varies due to the varying duration of operation or stop of the developing device, the above embodiment controls the peak-to-peak voltage of the bias in order to guarantee a stable developing characteristic. This obviates the excessive deposition of toner and thereby insures an image free from background contamination at all times.

5th Embodiment

A developing device for this embodiment basically has the configuration shown in FIG. 1 except for the mean amount of charge of toner and will not be described specifically.

Figure 12:
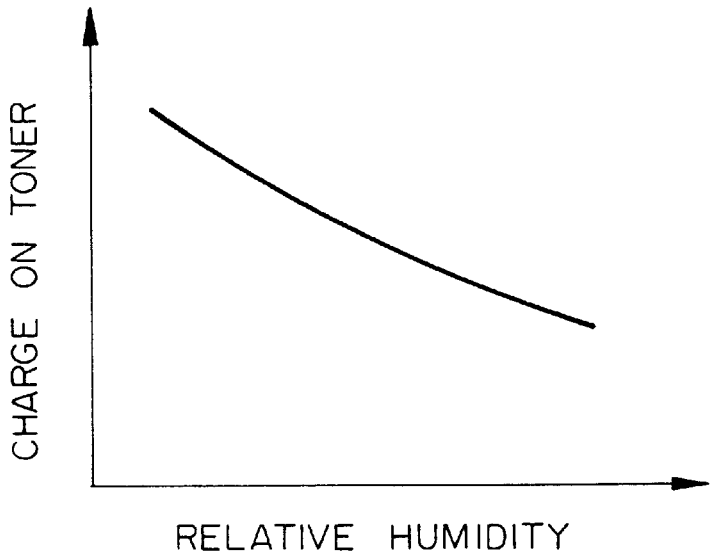
FIG. 12 shows a relation between humidity and the amount of charge to deposit on toner.

FIG. 12 shows the amounts of charge deposited on toner determined when the developer of the second embodiment consisting of low resistance magnetic carrier and highly chargeable toner was sufficiently mixed in particular humidity conditions. As FIG. 12 indicates, when humidity is high, the amount of charge to deposit on the toner is expected to decrease and, in turn, increase the image density or contaminate background.

In light of the above, this embodiment uses a humidity sensor or humidity sensing means. The peak-to-peak voltage of the bias to be applied to the sleeve 2 is determined in relation to the output of the humidity sensor in order to obviate excessive toner deposition and background contamination. The relation between the peak-to-peak voltage and humidity should only be determined beforehand by, e.g. experiments.

Figure 13:
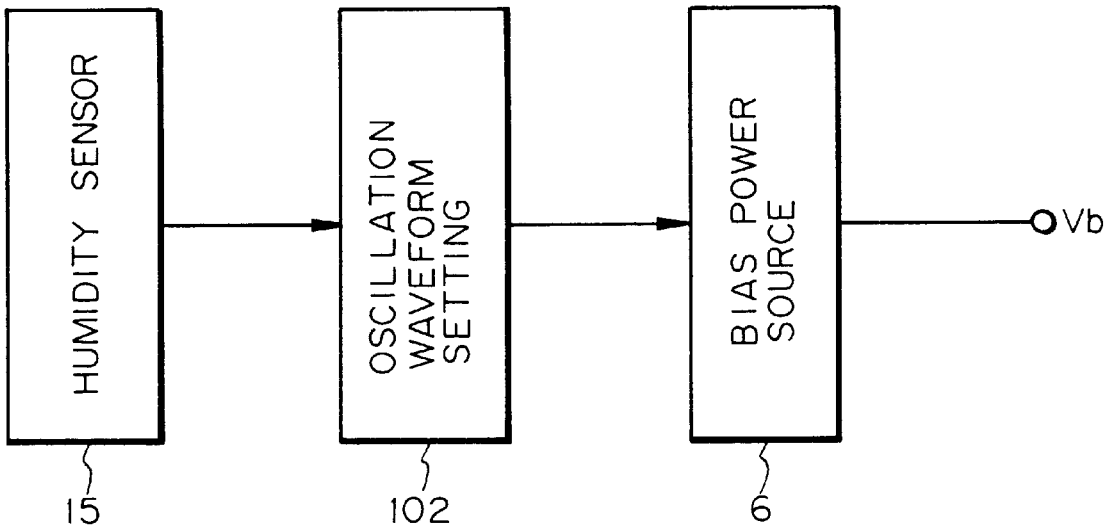
FIG. 13 is a block diagram schematically showing a control system representative of a fifth embodiment of the present invention.

FIG. 13 shows a control system or control means for varying the peak-to-peak voltage of the bias corresponding to the peak-to-peak value of the oscillation electric field on the basis of humidity sensed by a humidity sensor 15. The humidity sensor 15 is responsive to humidity inside the developing device shown in FIG. 1, humidity inside the apparatus including the developing device, or humidity around it.

As shown in FIG. 13, humidity sensed by the humidity sensor 15 is input to the oscillation waveform setting 102. The waveform setting 102 sets a peak-to-peak voltage matching with the current humidity. Data relating to the set peak-to-peak voltage is fed to the bias power source 6. In response, the bias power source 6 applies a bias $V_b$ having a newly set peak-to-peak voltage to the sleeve 2.

Humidities and corresponding peak-to-peak voltages are stored in the oscillation waveform setting 102 in the form of a conversion table based on the data shown in FI, G. 12. A peak-to-peak voltage is set on the basis of the conversion table.

As stated above, even when the amount of charge to deposit on the toner changes with a change in humidity, the illustrative embodiment adjusts the peak-to-peak voltage of the bias in order to insure a stable developing characteristic. This successfully obviates excessive toner deposition and guarantees an image free from background contamination at all times.

6th Embodiment

A developing device for this embodiment basically has the configuration shown in FIG. 1 except for the mean amount of charge of toner and will not be described specifically.

Figure 14:
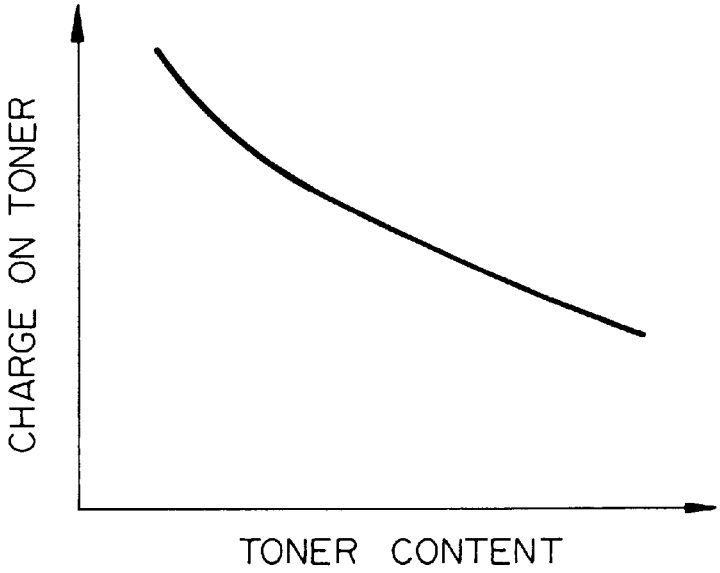
FIG. 14 shows a relation between toner content and the amount of charge to deposit on toner.

FIG. 14 shows the amounts of charge deposited on toner determined when the developer of the second embodiment consisting of low resistance magnetic carrier and highly chargeable toner was mixed with a different toner content. As FIG. 14 indicates, the toner content is high, the amount of charge to deposit on the toner tends to decrease and is expected to increase image density or contaminate background.

In light of the above, this embodiment uses a toner content sensor or toner content sensing means. The peak-to-peak voltage of the bias to be applied to the sleeve 2 i s determined in relation to the output of the toner content sensor in order to obviate excessive toner deposition and background contamination. The relation between the peak-to-peak voltage and the toner content should only be determined beforehand by, e.g. experiments.

Figure 15:
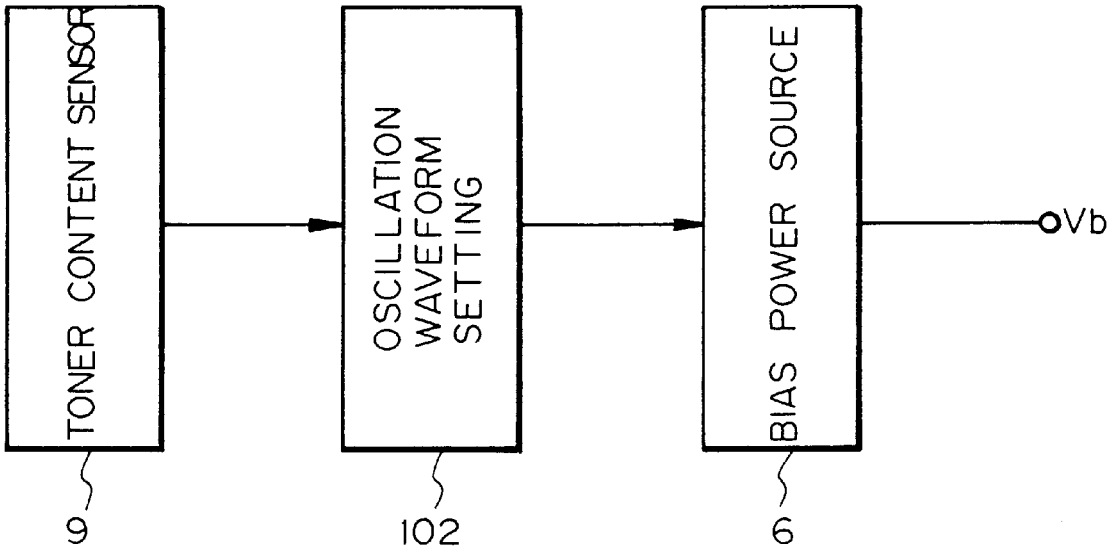
FIG. 15 is a block diagram schematically showing a control system representative of a sixth embodiment of the present invention.

FIG. 15 shows a control system or control means for varying the peak-to-peak voltage of the bias corresponding to the peak-to-peak value of the oscillation electric field on the basis of the toner content sensed by a toner content sensor 9. The toner content sensor 9 is disposed in the developing device. As shown in FIG. 15, a toner content sensed by the toner content sensor 9 is input to the oscillation waveform setting 102. The waveform setting 102 sets a peak-to-peak voltage matching with the current toner content. Data relating to the set peak-to-peak voltage is fed to the bias power source 6. In response, the bias power source 6 applies a bias $V_b$ having a newly set peak-to-peak voltage to the sleeve 2.

Toner contents and corresponding peak-to-peak voltages are stored in the oscillation waveform setting 102 in the form of a conversion table based on the data shown in FIG. 14. A peak-to-peak voltage is set on the basis of the conversion table.

As stated above, even when the amount of charge to deposit on the toner changes with a change in toner content, the illustrative embodiment adjusts the peak-to-peak voltage of the bias in order to insure a stable developing characteristic. This successfully obviates excessive toner deposition and guarantees an image free from background contamination at all times.

To effect the above control, the toner content sensor 9 may be replaced with a reflection type optical sensor or similar sensor responsive to the amount of toner deposition on the drum 10 which changes with a change in the toner content in the developing device. Further, the output of the toner content sensor 9 may be used to control the amount of toner to be replenished into the developing device, so that a stable image can be insured over a long period of time.

7th Embodiment

Figure 16:
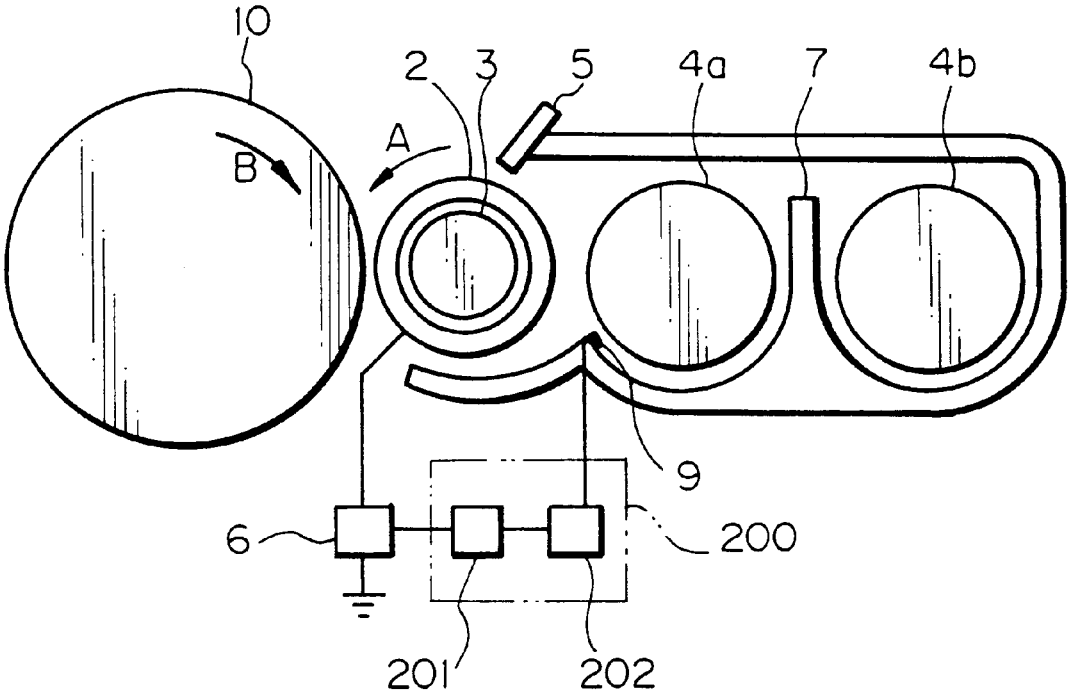
FIG. 16 is a section showing a seventh embodiment of the present invention.

Referring to FIG. 16, a seventh embodiment of the present invention will be described. Briefly, a developing device of this embodiment includes a developer carrier for carrying a toner and carrier mixture or developer magnetically thereon, and bias applying means for superposing an AC voltage on a DC voltage to generate a bias having a rectangular waveform and applying the bias to the developer carrier. The bias has a first potential portion causing the toner to move from the developer carrier toward an image carrier and a second portion causing it to move from the image carrier toward the developer carrier. The developer carrier applied with the bias conveys the developer to a developing region where the developer carrier and image carrier face each other, thereby developing a latent image formed on the image carrier.

Figure 17:
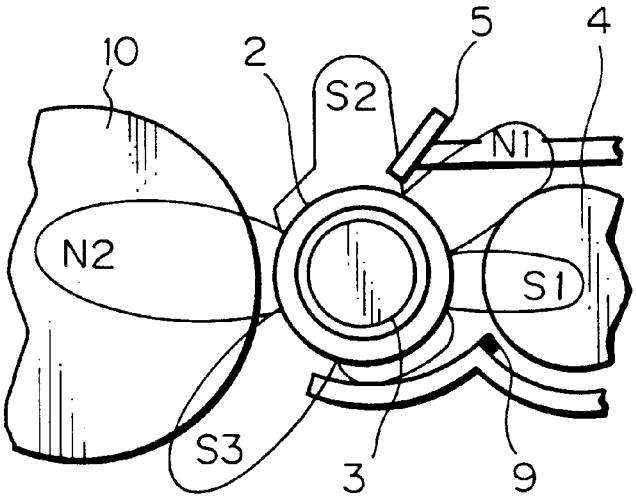
FIG. 17 shows the distribution of magnetic forces in the radial direction of a developing sleeve and particular to the seventh embodiment.

FIG. 17 shows the distribution of magnetic forces extending in the radial direction of the sleeve 2. In this embodiment, the developing device uses so-called reversal development, i.e., deposits the toner on the area of the image carrier where the charge potential has been removed.

The sleeve 2 is a hollow cylinder formed of a nonmagnetic material and arranged in parallel with the axis of rotation of the drum 10. A magnetic roll (stationary magnet) 3 having S poles and N poles alternately arranged, as shown in FIG. 17, is disposed in the sleeve 2. When the sleeve 2 is rotated in the direction indicated by an arrow A in FIG. 16, the developer is deposited on the sleeve 2 in the form of a magnet brush due to the force of the magnet roll 3. For the developer, use may be made of a toner and magnetic carrier mixture having a preselected mixture ratio. The sleeve 2 conveys the developer to the surface of the drum 10 rotating in the direction indicated by an arrow B. The doctor or regulating member 5 regulates the developer deposited on the sleeve 2 to a preselected thickness, as stated earlier.

A first and a second agitator 4*a* and 4*b* extend in the axial direction of and in parallel with the sleeve 7. A partition 7 separates an agitating region to which the first agitator 4*a* belongs and an agitating region to which the second agitator 4*b* belongs. The agitator 4*a* adjoins the sleeve 2 while the agitator 4*b* adjoins a toner replenishing opening, not shown, communicated to a toner replenishing device, not shown. The toner replenishing device is arranged at one side of the developing device. Clearances for interchanging the developer are formed between the front and rear ends of the partition, with respect to the axial direction of the sleeve 2, and the inner surfaces of opposite side walls of the developing device. The agitators 4*a* and 4*b* each is driven by a respective drive section, not shown, so as to agitate the developer while conveying it in opposite directions to each other in the axial direction of the sleeve 2. As a result, the developer is circulated around the partition via the above clearances. In this manner, the developer is agitated and charged by the two agitators 4*a* and 4*b*. In the illustrative embodiment, the toner is charged to negative polarity.

Among the magnetic poles shown in FIG. 17, poles S1 and N1 serve to scoop up the developer being conveyed by the agitator 4*a* in the axial direction onto the sleeve 2. A pole S2 conveys the developer moved away from the doctor 5 to a developing region where the sleeve 2 and drum 10 face each other. A pole N2 is a main pole for development. A pole S3 is an auxiliary pole for the conveyance of the developer. Because the poles S3 and S1 form a repulsing magnetic field between them, the developer comes off the portion of the sleeve 2 intervening between the poles S3 and S1. This part of the developer is again conveyed by the two agitators 4*a* and 4*b* while being agitated.

While the developer is conveyed by the agitator 4*a* in the axial direction of the sleeve 2, it is fed to the sleeve 2 by the force of the magnet roll 3 disposed in the sleeve 2. The sleeve 2 deposits the developer magnetically and conveys it to the developing region. At this instant, the doctor 5 regulates the thickness of the developer. In the developing region, the developer is transferred from the sleeve 2 to the drum 10 so as to develop a latent image formed on the drum 10.

Specifically, the surface of the drum 10 is uniformly charged to a preselected potential, e.g., −900 V, at a position upstream of the developing region in the direction of rotation of the drum 10. A laser is driven in accordance with image data in order to write an image on the charged surface of the drum 10. The image on the drum 10 has a preselected potential, e.g., −200 V. The charged toner of the developer in the form of a magnet brush deposits on the image and thereby produces a corresponding toner image.

The bias power source 6 is connected to the sleeve 2 and applies an AC-biased DC voltage to the sleeve 2 as a bias for development. In the illustrative embodiment, the bias has a rectangular waveform. How the bias is applied to the sleeve 2 will be described later specifically.

The magnet brush formed by the developer on the sleeve 2 is regulated to a thickness of 0.5 mm by the doctor 5. The sleeve 2 and drum 10 are spaced by a gap of 0.6 mm. The sleeve 2 rotates at a linear velocity of 225 mm/sec which is two and half times as high as a linear speed of 90 mm/sec assigned to the drum 10.

The toner of the developer existing in the developing device is sequentially consumed due to repeated development. The toner content sensor 9 mounted in the lower portion of the developing device in order to sense the toner content of the developer at a preselected timing, e.g., once for a single copy. The toner replenishing device replenishes fresh toner into the developing device in accordance with the output of the toner content sensor 9. As a result, the toner content in the developing device is held in a preselected range, maintaining image density constant. For the toner content sensor 9, use may be made of a permeability sensor responsive to the permeability of the developer.

The illustrative embodiment obviates the variation of image density ascribable to the variation of toner content by using a relation between the DC voltage and the duty ratio of the AC voltage of the bias and image density The relation between the DC voltage and the duty ratio of the AC voltage and image density will be described first.

Figure 18:
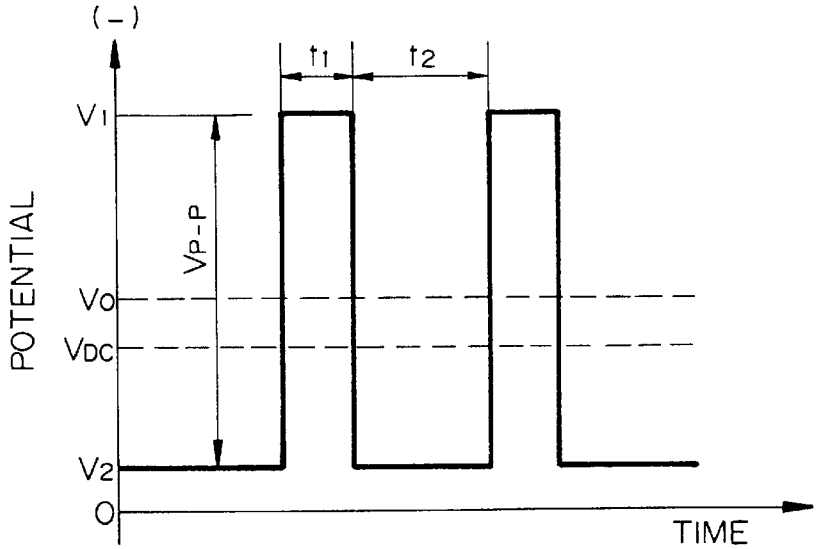
FIG. 18 shows the waveform for a bias for development and used in the seventh embodiment.

FIG. 18 shows the waveform of the bias applied to the sleeve 2. As shown, the bias has a first potential portion causing the toner to move from the sleeve 2 toward the drum and a second potential portion causing it to move from the drum 10 toward the sleeve 2. The first and second potential portions alternate with each other. To generate such a bias, an AC voltage having a rectangular waveform and a peak-to-peak voltage $V_{p-p}$ which is equal to the absolute value of the difference between the potential $V_1$ of the first potential portion and the potential $V_2$ of the second potential portion, i.e., $|(V_1-V_2)|$, is superposed on a preselected DC voltage $V_0$. Assume that in one period of the AC voltage the duration of the potential $V_1$ causing the toner to move from the sleeve 2 toward the drum 10 is $t_1$, and that the duration of the potential $V_2$ causing it to move from the drum 10 toward the sleeve 2 is $t_2$. Then, the duty ratio refers to the ratio of the duration $t_1$ to one period T $(=t_1+t_2)$, i.e., $t_1/(t_1+t_2)\times 100$ (%).

In FIG. 18, a time-average voltage $V_{DC}$ is also shown and refers to the time average of the bias. The time-average voltage $V_{DC}$ can be set on the basis of the duty ratio and peak-to-peak voltage $V_{p-p}$ of the AC voltage and the DC voltage $V_0$.

Figure 19:
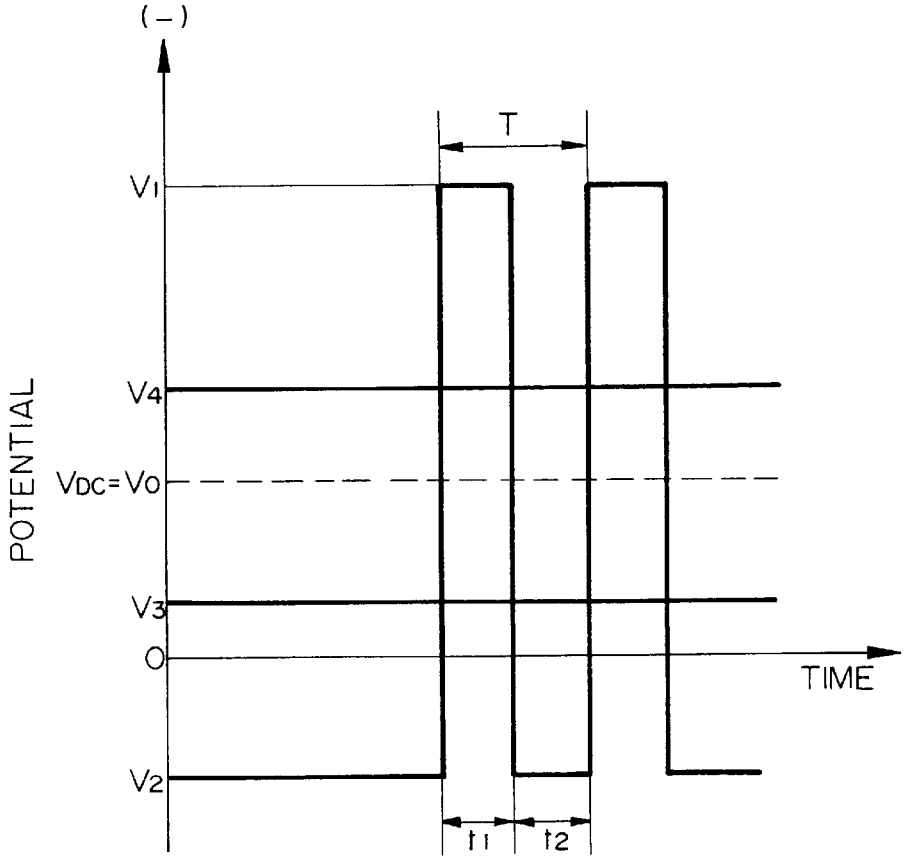
FIG. 19 shows the waveform of the bias to appear when the duty ratio of 50% is set up.

Hereinafter will be described the results of experiments which we conducted to examine a relation between the DC voltage and AC voltage of the bias and image density. First, development was effected with a duty ratio of 50% while observing the toner content of the developer existing in the developing device. For the development, the bias had a peak-to-peak value $V_{p-p}$ of 2 kV, $V_1$ of −1,600 V, $V_2$ of +400 V, $V_{DC}=V_0$ of −600 V, frequency f of 5 kHz, period T of 200 μs, and $t_1=t_2=100\times\mu s$. The toner of the developer had a particle size of 7.5 μm. while the carrier had a particle size of 50 μm. The carrier had a relatively low resistance of the order of $10^8$ to $10^9$. The waveform of such a bias is shown in FIG. 19 together with a potential $V_3$ of −200 V and a potential $V_4$ of −900 V respectively deposited on the image portion and non-image portion of the drum 10. How the image density varies in accordance with the potential for development, i.e., a difference between the time-average voltage and the potential of the drum 10, is shown in FIG. 19.

Figure 20:
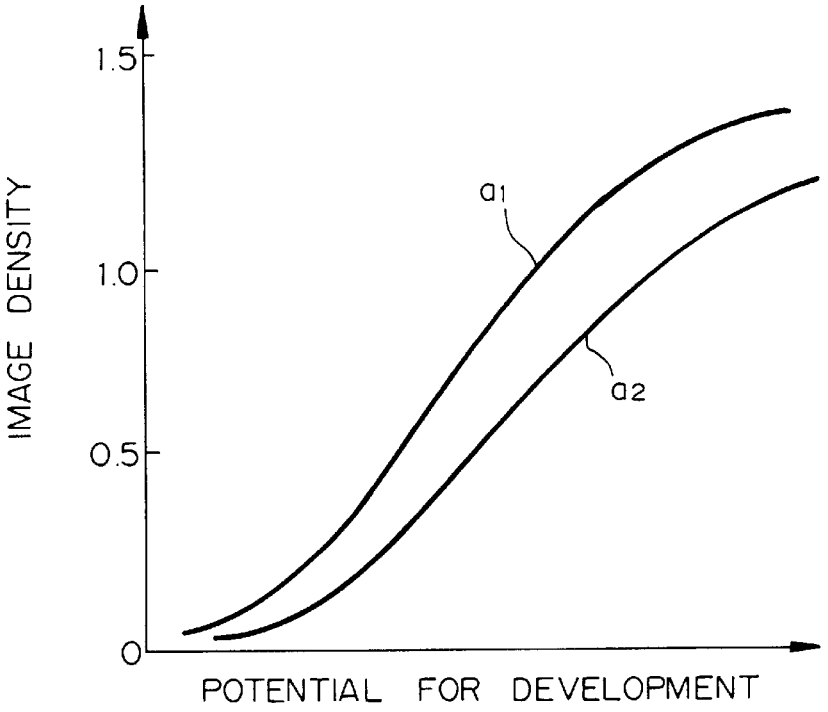
FIG. 20 shows how image density varies with the potential for development when development is effected with the duty ratio of 50%.

As a curve $a_1$ shown in FIG. 20 indicates, sufficient image density was achieved under the bias conditions of FIG. 19 for some time after the start of development. However, as the toner content decreased with the elapse of time, sufficient image density was lost, as indicated by a curve $a_2$ in FIG. 20. This is because the amount of charge deposited on the toner increased due to a decrease in toner content.

Figure 21:
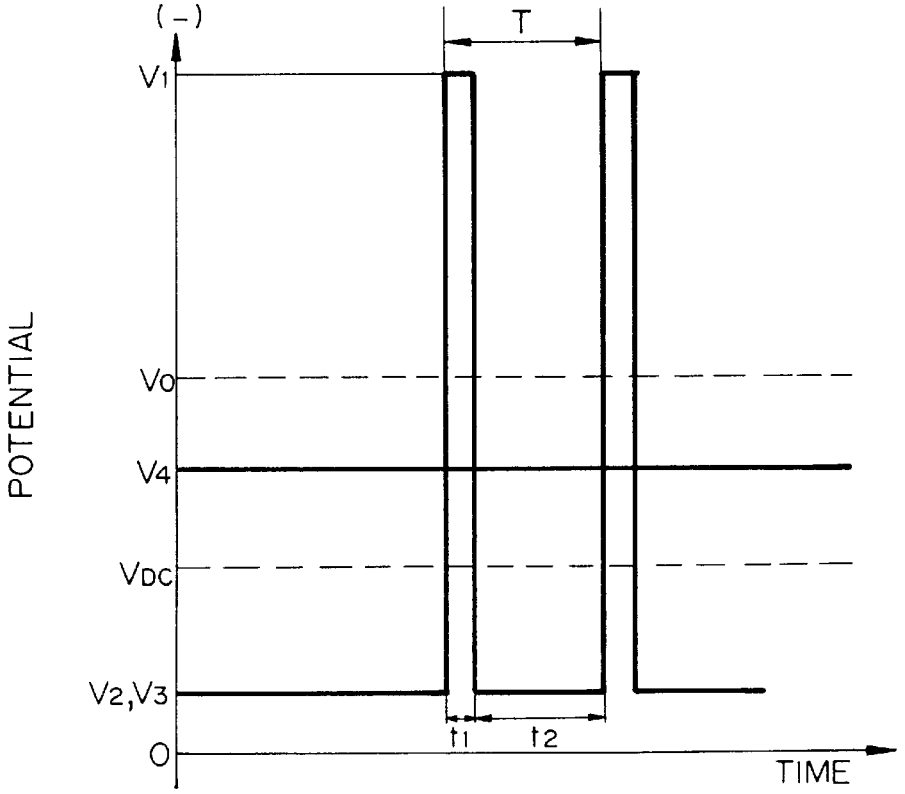
FIG. 21 shows the waveform of the bias to appear when the duty ratio is 20%.
Figure 22:
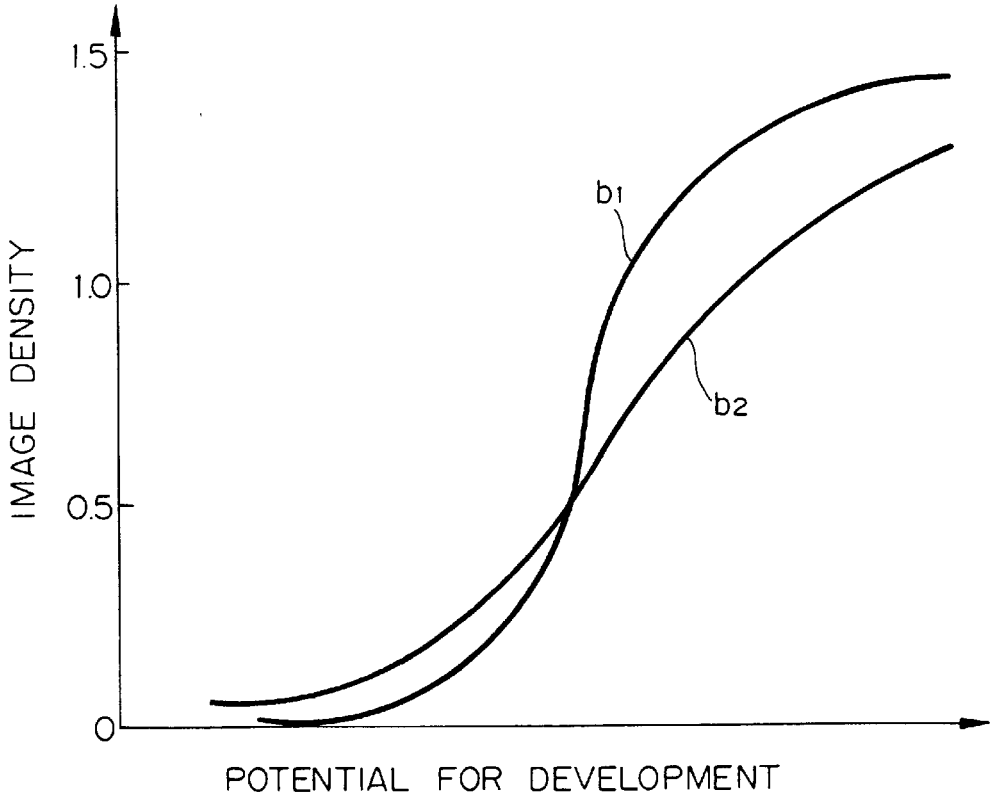
FIG. 22 shows how image density varies with the potential for development when development is effected with the duty ratio of 20% after the fall of toner content.

When the toner content decreased, as stated above, development was effected by reducing the duty ratio to 20% and causing the power source 6 to apply a DC voltage providing $V_{DC}$ of −600 V. The developing conditions were $V_{p-p}$ of 2 kV, $V_1$=−2,200 V, $V_2$=−200 V, $V_0$=−1,200 V, frequency f=5 kHz, period T=200 μs, $t_1$=40 μs, and $t_2$=160 μs. The waveform of such a bias is shown in FIG. 21 together with a potential $V_3$ of −200 V and a potential $V_4$ of −900 V respectively deposited on the image portion and non-image portion of the drum 10. How the image density varies in accordance with the potential for development is shown in FIG. 22 together with the curve $a_2$ of FIG. 20. By reducing the duty ratio to 20%, sufficient image density was achieved despite the fall of toner content. In addition, carrier deposition did not occur because the frequency was as high as 5 kHz.

The duty ratio of the AC voltage was increased within the range of from 50% to 90% while $V_{DC}$ was held at −600 V. In this case, although target image density was achieved, a margin up to the target value was small, compared to the case wherein the duty ratio was reduced. Further, irregularity among dots constituting an image was aggravated while the trailing edge of an image was lost or blurred. On the other hand, when the duty ratio was reduced below 20%, it deteriorated image quality to a critical degree. This is because the toner moving from the sleeve 2 toward the drum 10 cannot oscillate or become active.

It will be seen from the above that even when desired image density is difficult to achieve due to a decrease in toner content, i.e., an increase in the amount of charge, it is possible to prevent image density from decreasing and improve uniformity of dots if the frequency is held constant, if the duty ratio of the AC voltage of the bias is varied within a preselected range, e.g., from 20% to 50%, and if the power source 6 is so controlled as to maintain the time-average voltage constant.

Figure 25:
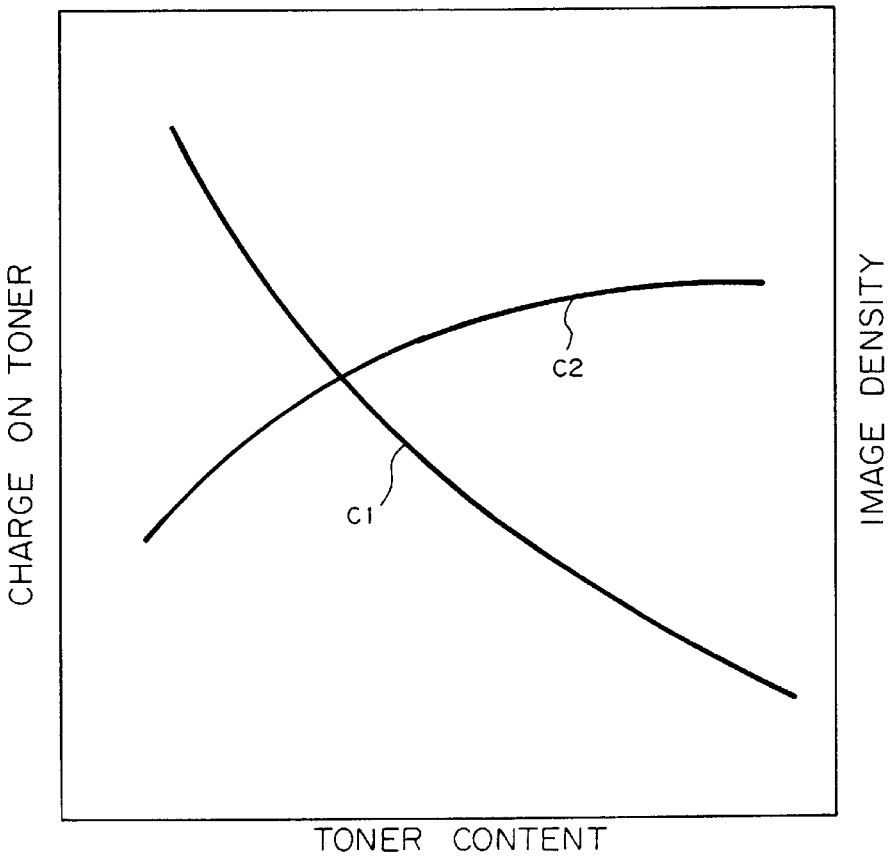
FIG. 25 shows a relation between the toner content, the amount of charge of toner, and image density.

The illustrative embodiment has a configuration for maintaining the frequency constant and rendering the duty ratio of the AC voltage and DC voltage variable in order to prevent image density from falling and improving the uniformity of dots. Specifically, the embodiment includes control means (bias varying means) for controlling the duty ratio of the AC voltage and DC voltage on the basis of the output of the toner sensor 9. For this purpose, the control means uses the relation between the toner content, the amount of charge to deposit on the toner, and image density shown in FIG. 25 and the relation between the toner content and the duty ratio of the AC voltage and DC voltage determined by the above experiments.

Figure 23:
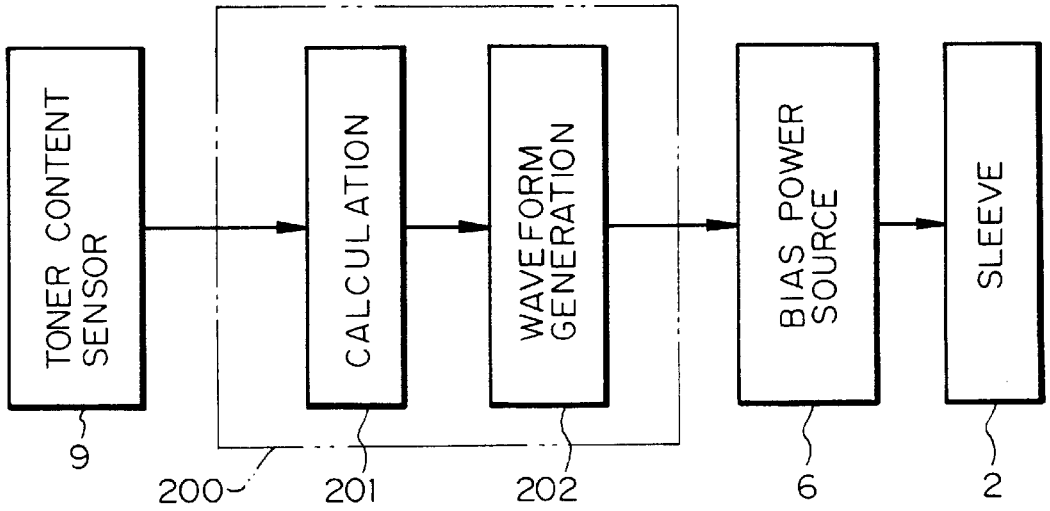
FIG. 23 is a block diagram schematically showing a specific configuration of a controller included in the seventh embodiment.

FIG. 23 shows the controller or control means designated by the reference numeral 200. As shown, the controller 200 includes a calculation 201 for converting the toner content data output from the toner content sensor 9 to image density, and then calculating an AC voltage duty ratio and a DC voltage for correcting a difference between the above image density and target image density. A waveform generation 202 generates a waveform based on the output of the calculation 201 and causes the power source 6 to output a bias based on the generated waveform. Specifically, when the toner content is likely to fall and increase the amount of charge to deposit on the toner, the duty ratio of the AC voltage is reduced while the DC voltage is so controlled as to have a constant time-average voltage. This successfully prevents image density from decreasing and insures a desirable image with uniform dots.

Further, because the above controller automatically controls the bias in accordance with the toner content, the apparatus is easy to operate.

In the illustrative embodiment, even when the duty ratio of the AC voltage is varied, the time-average voltage produced from the absolute value of the difference between the first and second potential portions, the duty ratio of the AC voltage and DC voltage are maintained constant. Therefore, the variation of image density ascribable to the variation of the time-average voltage is reduced.

When the peak-to-peak voltage is varied in order to maintain the time-average voltage constant, carrier deposition and fog are likely to occur. The illustrative embodiment guarantees desirable image density without any carrier deposition or fog because it controls the DC voltage while maintaining the peak-to-peak voltage constant.

Figure 24:
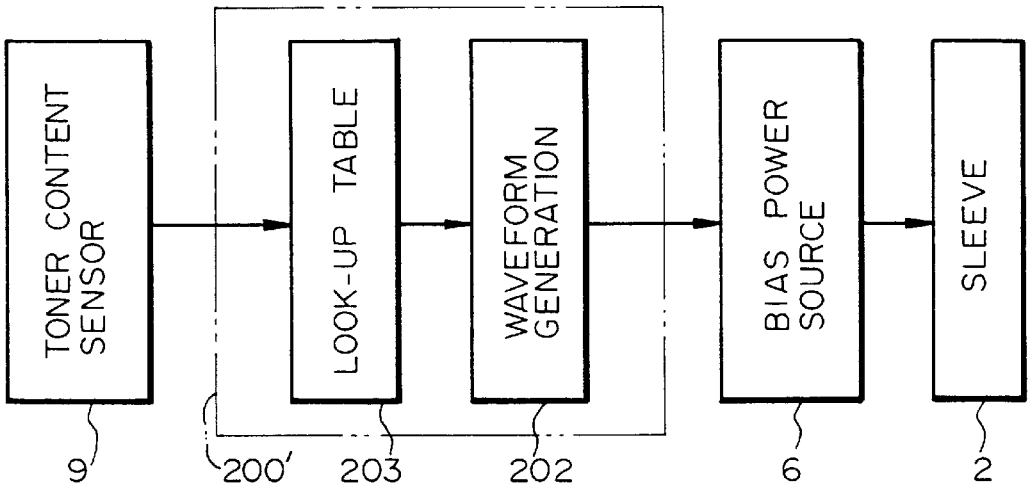
FIG. 24 is a block diagram schematically showing a modified form of the controller of FIG. 23.

FIG. 24 shows a modification of the above controller. As shown, a controller 200' has a look-up table 203 and the waveform generation 202. The look-up table 203 lists data representative of toner density and bias for implementing target image density on the basis of the relation between the toner content and the AC voltage duty ratio and DC voltage of the bias, specifically the potential $V_1$ and duration $t_1$ of the first potential portion, the potential $V_2$ and duration $t_2$ of the second potential portion, and the DC voltage $V_0$. The waveform generation 202 generates a waveform by referencing the look-up table 201 and causes the power source 6 to output a bias having the generated waveform. The controller selects, based on the output of the toner content sensor 9, data relating to a bias necessary for implementing target image density out of the table 203. The data selected is fed to the waveform generation 202 with the result that the power source 6 outputs a bias based on the above data. Specifically, when the toner content is likely to fall and increase the amount of charge to deposit on the toner, the duty ratio of the AC voltage is reduced while the DC voltage is so controlled as to have a constant time-average voltage. This successfully prevents image density from decreasing and insures a desirable image with uniform dots.

While the toner sensing means responsive to the toner content has been shown and described as comprising a toner density sensor in the embodiments, use may be made of an arrangement for sensing the toner content in terms of a reflection from the toner deposited on a latent image.

In each of the embodiments shown and described, while the controller automatically controls the bias on the basis of the toner content, the user of the apparatus may adjust the bias by hand, if desired. For example, when the user watching an output image determines that the density of the image is low, the user may vary the density on, e.g., an operation panel mounted on the top of the apparatus. Further, a program estimating the variation of toner content due to aging may be stored in the controller, in which case the controller will control the bias on the basis of such a program.

The present invention is, of course, practicable with non-reversal development as distinguished from the reversal development described in relation to the embodiments. Also, the present invention is practicable even with a toner and carrier mixture containing additives.

In summary, it will be seen that the present invention provides an image forming apparatus having various unprecedented advantages, as enumerated below.

(1) An oscillation electric field is formed in a developing region. Toner contained in a developer is caused to move toward an image carrier over a preselected period of time matching with the particle size of the toner. In addition, the frequency of the above electric field is determined in accordance with the particle size of carrier also contained in the developer. Therefore, the electric field has conditions optimal for the developer and allows the toner to efficiently deposit on a latent image. This insures a desirable image with uniform dots (uniform reproduction of halftone) and including a minimum of noise.

(2) Because the oscillation component of the bias reflects information relating to the particle size of toner and that of carrier, optimal development is achievable even when the developer is changed.

(3) When low resistance carrier is used in combination with the above oscillation electric field, the electric field in the developing region increases in size to promote more efficient movement of the toner and allows the toner to deposit on an image carrier faithfully. This also insures a desirable image with uniform dots (uniform reproduction of halftone) and including a minimum of noise.

(4) When image density is apt to fall, the duty ratio of an AC voltage is reduced while a DC voltage is is so controlled as to have a time-average value of the same degree as a time-average voltage occurred before the variation of the duty ratio. It is therefore possible to maintain image density possible and insure uniform dots.

(5) Background contamination and other image noise ascribable to toner of short charge is obviated, and a stable developing characteristic is achievable.

(6) The amount of toner for development remains constant without regard to the variation of the amount of charge to deposit on the toner, also insuring a stable developing characteristic.

(7) A stable developing characteristic is guaranteed even when the amount of charge varies in dependence on the duration of operation of a developing device.

(8) A stable developing characteristic is guaranteed even when the amount of charge varies in dependence on the duration of stop of operation of the developing device.

(9) A stable developing characteristic is guaranteed even when the amount of charge varies in dependence on humidity.

(10) A stable developing characteristic is guaranteed even when the amount of charge varies due to varying toner content of the developer.

(11) Toner content sensing means senses the toner content of the developer. The bias for development is automatically controlled on the basis of the output of the sensing means such that desired image density and uniform dots are insured.

(12) Because the time-average voltage is maintained constant, the variation of image density ascribable to the variation of the time-average voltage is reduced.

(13) Because the amplitude of the AC voltage is maintained constant, the DC voltage can be varied in order to maintain the time-average voltage constant. This obviates carrier deposition and fog.

Various modifications will become possible for those skilled in the art after receiving the teachings of the present disclosure without departing from the scope thereof.

What is claimed is:

1. An image forming apparatus comprising:

an image carrier for electrostatically forming a latent image thereon;

a developer carrier for conveying a developer consisting of toner and carrier while retaining the developer thereon, and causing the toner to deposit on the latent image formed on said image carrier; and means for forming an oscillation electric field between said image carrier and said developer carrier for causing the toner to move;

wherein a period of time assigned to a phase for causing the toner to move toward the latent image is $t_1$, a period of said oscillation electric field is T, a mass-average particle size of the toner is $L_t$, and a mass-average particle size of the carrier is $L_c$, and the following conditions are satisfied:

$$1.0\times10^{-4}<t_1^2/L_t<1.0\times10^{-4}(\sec^2/m)$$

$$T^2/L_c<0.005(\sec^2/m).$$

2. An apparatus as claimed in claim 1, wherein a mean amount of charge to deposit on the toner is greater than 40 $\mu$C/g inclusive in absolute value, but smaller than 100 $\mu$C/g inclusive in absolute value, as measured by a blow-off method.

3. An apparatus as claimed in claim 1, further comprising control means for varying a peak-to-peak value of said oscillation electric field.

4. An apparatus as claimed in claim 3, further comprising varying means for varying the peak-to-peak value in accordance with a duration of operation of a developing device accommodating said developer carrier and accompanied by mixing of the developer in said developing device.

5. An apparatus as claimed in claim 3, further comprising varying means for varying the peak-to-peak value in accordance with a duration of stop of operation of a developing device accommodating said developer carrier and accompanied by mixing of the developer in said developing device.

6. An apparatus as claimed in claim 3, further comprising varying means for varying the peak-to-peak value in accordance with humidity in or around a developing device accommodating said developer carrier.

7. An apparatus as claimed in claim 3, further comprising varying means for varying the peak-to-peak value in accordance with a toner content of the developer existing in a developing device accommodating said developer carrier or an amount of the toner deposited on said image carrier.

8. An image forming apparatus comprising:

an image carrier for electrostatically forming a latent image thereon;

a developer carrier for conveying a developer consisting of toner and carrier while retaining the developer thereon, and causing the toner to deposit on the latent image formed on said image carrier; and means for forming an oscillation electric field between said image carrier and said developer carrier for causing the toner to move;

wherein the carrier has a volume resistivity of lower than $10^{10}$ Ωcm inclusive, and wherein a period of time assigned to a phase for causing the toner to move toward the latent image is $t_1$, a period of said oscillation electric field is T, a mass-average particle size of toner is $L_t$, and a mass-average particle size of the carrier is $L_c$, and the following conditions are satisfied:

$$1.0\times10^{-4}<t_1^2/L_t<5.0\times10^{-4}(\sec^2/m)$$

$$T^2/L_c<0.002(\sec^2/m).$$

9. An apparatus as claimed in claim 8, wherein a mean amount of charge to deposit on the toner is greater than 40 μC/g inclusive in absolute value, but smaller than 100 μC/g inclusive in absolute value, as measured by a blow-off method.

10. An apparatus as claimed in claim 8, further comprising control means for varying a peak-to-peak value of said oscillation electric field.

11. An apparatus as claimed in claim 10, further comprising varying means for varying the peak-to-peak value in accordance with a duration of operation of a developing device accommodating said developer carrier and accompanied by mixing of the developer in said developing device.

12. An apparatus as claimed in claim 10, further comprising varying means for varying the peak-to-peak value in accordance with a duration of stop of operation of a developing device accommodating said developer carrier and accompanied by mixing of the developer in said developing device.

13. An apparatus as claimed in claim 10, further comprising varying means for varying the peak-to-peak value in accordance with humidity in or around a developing device accommodating said developer carrier.

14. An apparatus as claimed in claim 10, further comprising varying means for varying the peak-to-peak value in accordance with a toner content of the developer existing in a developing device accommodating said developer carrier or an amount of the toner deposited on said image carrier.

15. An image forming apparatus comprising:

an image carrier for electrostatically forming a latent image thereon;

a developer carrier for conveying a developer consisting of toner and carrier while retaining the developer thereon, and causing the toner to deposit on the latent image formed on said image carrier; and control means for forming, with an AC voltage and a DC voltage, an oscillation electric field for causing the toner to move between said image carrier and said developer carrier, and varying a duty ratio of the AC voltage and the DC voltage in accordance with a change in a developing condition.

16. An apparatus as claimed in claim 15, further comprising varying means for varying the duty ratio of the AC voltage and the DC voltage in accordance with a duration of operation of a developing device accommodating said developer carrier and accompanied by mixing of the developer in said developing device.

17. An apparatus as claimed in claim 15, further comprising varying means for varying the duty ratio of the AC voltage and the DC voltage in accordance with a duration of stop of operation of a developing device accommodating said developer carrier and accompanied by mixing of the developer in said developing device.

18. An apparatus as claimed in claim 15, further comprising varying means for varying the duty ratio of the AC voltage and the DC voltage in accordance with a toner content of the developer existing in a developing device accommodating said developer carrier or an amount of the toner deposited on said image carrier.

19. An apparatus as claimed in claim 15, wherein a time-average value of said oscillation electric field is maintained constant when the duty of the AC voltage and the DC voltage are varied.

20. An apparatus as claimed in claim 19, wherein the AC voltage has a constant amplitude.

21. An image forming apparatus comprising:

an image carrier for electrostatically forming a latent image thereon;

a developer carrier for conveying a developer consisting of toner and carrier while retaining the developer thereon, and causing the toner to deposit on the latent image formed on said image carrier;

control means for forming, with an AC voltage and a DC voltage, an oscillation electric field for causing the toner to move between said image carrier and said developer carrier, and varying a duty ratio of the AC voltage and the DC voltage based on a characteristic of the developer carrier; and varying means for varying the duty ratio of the AC voltage and the DC voltage in accordance with humidity in or around a developing device accommodating said developer carrier.

22. An image forming apparatus comprising:

an image carrier for electrostatically forming a latent image thereon;

a developer carrier for conveying a developer consisting of toner and carrier while retaining the developer thereon, and causing the toner to deposit on the latent image formed on said image carrier; and control means for forming, with an AC voltage and a DC voltage, an oscillation electric field for causing the toner to move between said image carrier and said developer carrier, and varying a duty ratio of the AC voltage and the DC voltage based on a characteristic of the developer carrier.

23. An apparatus as claimed in claim 22, further comprising varying means for varying the duty ratio of the AC voltage and the DC voltage in accordance with a duration of operation of a developing device accommodating said developer carrier and accompanied by mixing of the developer in said developing device.

24. An apparatus as claimed in claim 22, further comprising varying means for varying the duty ratio of the AC voltage and the DC voltage in accordance with a duration of stop of operation of a developing device accommodating said developer carrier and accompanied by mixing of the developer in said developing device.

25. An apparatus as claimed in claim 22, further comprising varying means for varying the duty ratio of the AC voltage and the DC voltage in accordance with a toner content of the developer existing in a developing device accommodating said developer carrier or an amount of the toner deposited on said image carrier.

26. An apparatus as claimed in claim 22, wherein a time-average value of said oscillation electric field is maintained constant when the duty of the AC voltage and the DC voltage are varied.

27. An apparatus as claimed in claim 26, wherein the AC voltage has a constant amplitude.

* * * * *

UNITED STATES PATENT AND TRADEMARK OFFICE

CERTIFICATE OF CORRECTION

PATENT NO. : 5,937,228

DATED : August 10, 1999

INVENTOR(S): Hisashi SHOJI, et al.

It is certified that an error appears in the above-identified patent and that said Letters Patent is hereby corrected as shown below:

On the title page, item [30] Foreign Application Priority Data has been omitted. It should be:

--[30] Foreign Application Priority Data
Jan. 17, 1997 [JP] Japan ..... 9-006628
Jan. 23, 1997 [JP] Japan ..... 9-026137
Apr. 25, 1997 [JP] Japan ..... 9-123451
Dec. 19, 1997 [JP] Japan ..... 9-365348--

Signed and Sealed this

Sixteenth Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,937,228

DATED : August 10, 1999

INVENTOR(S) : Hisashi SHOJI ET AL.

It is certified that error appears in the above-indentified patent and that said Letters Patent is hereby corrected as shown below:

Column 22, line 56, please change "$1.0 \times 10^{-4} < t_1^2/L_t < 1.0 \times 10^{-4}$[sec$^2$/m]" to --$1.0 \times 10^{-4} < t_1^2/L_t < 1.0 \times 10^{-3}$ [sec$^2$/m]--.

Signed and Sealed this

Twelfth Day of December, 2000

*Attest:*

*Attesting Officer*

Q. TODD DICKINSON

*Director of Patents and Trademarks*